US008646866B2

(12) United States Patent
Otsuki

(10) Patent No.: US 8,646,866 B2
(45) Date of Patent: Feb. 11, 2014

(54) RECORDING APPARATUS, RECORDING METHOD, PROGRAM, AND COMPUTER SYSTEM

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 927 days.

(21) Appl. No.: 12/663,169

(22) Filed: Dec. 4, 2009

(65) Prior Publication Data

US 2010/0328386 A1 Dec. 30, 2010

Related U.S. Application Data

(63) Continuation of application No. 10/521,318, filed as application No. PCT/JP03/09945 on Aug. 5, 2003, now Pat. No. 7,651,188.

(30) Foreign Application Priority Data

Aug. 8, 2002 (JP) ..... 2002-231213
Aug. 21, 2002 (JP) ..... 2002-241016
Aug. 21, 2002 (JP) ..... 2002-241017

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS 3,968,498 A 7/1976 Uchiyama
4,198,642 A 4/1980 Gamblin
4,364,060 A 12/1982 Jinnai et al.
5,140,429 A 8/1992 Ebinuma et al.
5,192,141 A 3/1993 Chung et al.
5,291,227 A 3/1994 Suzuki
5,609,426 A 3/1997 Ito et al.
5,629,529 A 5/1997 Motoyama
5,661,550 A 8/1997 Ko
5,671,163 A 9/1997 Iida (Continued)

FOREIGN PATENT DOCUMENTS

EP 0 461 610 A2 12/1991
EP 0 542 289 A2 5/1993

(Continued)

OTHER PUBLICATIONS

Office Action, U.S. Appl. No. 10/338,248, dated Jan. 11, 2006.

(Continued)

*Primary Examiner* — Lamson Nguyen

(57) ABSTRACT

A recording apparatus can be prevented from becoming dirty, for example, due to incorrectly loading a recording medium. If a width of the recording medium that has been detected by the detection means is shorter than a width, in the direction that intersects the carrying direction of the recording medium, over which the recording information is to be recorded, then a portion of the recording information, of the entire recording information, corresponding to the width, or to less than the width, of the recording medium that has been detected by the detection means is recorded onto the recording medium by the recording head. A notice is made when the width of the recording medium that has been detected by the detection means is different from a width of the size of the recording medium that has been set with the setting means. The ON/OFF of an operation through which the detection means detects the width of the recording medium is settable.

16 Claims, 14 Drawing Sheets

(56) References Cited

U.S. PATENT DOCUMENTS

| | | | |
|---|---|---|---|
| 5,710,587 | A | 1/1998 | Suzuki et al. |
| 5,717,446 | A | 2/1998 | Teumer et al. |
| 5,798,773 | A | 8/1998 | Hiramatsu et al. |
| 5,859,653 | A | 1/1999 | Aoki et al. |
| 5,870,114 | A | 2/1999 | Numata et al. |
| 5,917,995 | A | 6/1999 | Ota |
| 5,934,664 | A | 8/1999 | Murayama et al. |
| 5,940,106 | A | 8/1999 | Walker |
| 5,997,129 | A | 12/1999 | Matsuhashi |
| 6,039,481 | A | 3/2000 | Ham |
| 6,109,745 | A | 8/2000 | Wen |
| 6,161,914 | A | 12/2000 | Haselby |
| 6,189,993 | B1 | 2/2001 | Mantell |
| 6,213,659 | B1 | 4/2001 | Elgee |
| 6,234,694 | B1 | 5/2001 | Brookner |
| 6,239,817 | B1 | 5/2001 | Meyer |
| 6,241,334 | B1 | 6/2001 | Haselby |
| 6,318,839 | B1 | 11/2001 | Elgee |
| 6,371,592 | B1 | 4/2002 | Otsuka et al. |
| 6,454,390 | B1 | 9/2002 | Takahashi et al. |
| 6,464,417 | B2 | 10/2002 | Barbera et al. |
| 6,527,360 | B2 | 3/2003 | Otsuki et al. |
| 6,607,260 | B1 | 8/2003 | Ikeda |
| 6,840,617 | B2 | 1/2005 | Crosby et al. |
| 6,964,466 | B1 | 11/2005 | Kodama et al. |
| 7,401,881 | B2 | 7/2008 | Endo |
| 7,530,656 | B2 | 5/2009 | Endo et al. |
| 7,537,302 | B2 | 5/2009 | Endo |
| 7,549,813 | B2 | 6/2009 | Endo |
| 7,717,536 | B2 | 5/2010 | Endo |
| 7,775,654 | B2 | 8/2010 | Akase et al. |
| 7,830,564 | B2 | 11/2010 | Harada et al. |
| 7,914,096 | B2 | 3/2011 | Hagiwara et al. |
| 2002/0033851 | A1 | 3/2002 | Waldner et al. |
| 2002/0044168 | A1 | 4/2002 | Hashi et al. |

FOREIGN PATENT DOCUMENTS

| | | | |
|---|---|---|---|
| EP | 0556045 | A2 | 8/1993 |
| EP | 0 811 949 | A | 12/1997 |
| EP | 0816107 | A2 | 1/1998 |
| EP | 1043166 | A2 | 10/2000 |
| EP | 1096780 | A2 | 5/2001 |
| EP | 1 108 554 | A1 | 6/2001 |
| EP | 1190864 | A1 | 3/2002 |
| EP | 1531055 | A1 | 5/2005 |
| GB | 2321913 | A | 8/1998 |
| JP | 02-255360 | | 10/1990 |
| JP | 03-197162 | | 8/1991 |
| JP | 03-234621 | | 10/1991 |
| JP | 3-246089 | A | 11/1991 |
| JP | 04-021482 | | 1/1992 |
| JP | 04-154268 | A | 5/1992 |
| JP | 05-004395 | | 1/1993 |
| JP | 05-069608 | A | 3/1993 |
| JP | 05-110806 | A | 4/1993 |
| JP | 05-221103 | | 8/1993 |
| JP | 06-015888 | | 1/1994 |
| JP | 06-182988 | | 7/1994 |
| JP | 06-305221 | | 11/1994 |
| JP | 07-000912 | | 1/1995 |
| JP | 07-009712 | | 1/1995 |
| JP | 07-214822 | | 8/1995 |
| JP | 07-285248 | A | 10/1995 |
| JP | 08-002066 | A | 1/1996 |
| JP | 08-006331 | A | 1/1996 |
| JP | 08-132697 | | 5/1996 |
| JP | 09-030091 | | 2/1997 |
| JP | 09-141962 | | 6/1997 |
| JP | 10-072144 | | 3/1998 |
| JP | 10-138583 | | 5/1998 |
| JP | 10-291689 | | 11/1998 |
| JP | 11-048556 | | 2/1999 |
| JP | 11-110165 | | 4/1999 |
| JP | 11-170639 | | 6/1999 |
| JP | 11-193152 | | 7/1999 |
| JP | 11-240214 | | 9/1999 |
| JP | 11-291470 | | 10/1999 |
| JP | 11-305606 | | 11/1999 |
| JP | 2000-001033 | | 1/2000 |
| JP | 2000-020274 | A | 1/2000 |
| JP | 2000-118058 | | 4/2000 |
| JP | 2000-158776 | A | 6/2000 |
| JP | 2000-289252 | | 10/2000 |
| JP | 2000-351205 | | 12/2000 |
| JP | 2001-096874 | | 4/2001 |
| JP | 2002-67460 | A | 3/2002 |
| JP | 2002-103586 | | 4/2002 |
| JP | 2002-103721 | | 4/2002 |
| JP | 2009-234267 | | 10/2009 |
| JP | 2011-102197 | | 5/2011 |
| JP | 2012-144051 | | 8/2012 |

OTHER PUBLICATIONS

Office Action, U.S. Appl. No. 10/338,248, dated Feb. 26, 2007.
Office Action, U.S. Appl. No. 10/338,248, dated Jul. 7, 2008.
Office Action, U.S. Appl. No. 10/338,248, dated Jul. 27, 2005.
Office Action, U.S. Appl. No. 10/338,248, dated Aug. 3, 2006.
Office Action, U.S. Appl. No. 10/338,248, dated Oct. 24, 2007.
EPO Communication for Application No. 03794123.4-2304 dated Jun. 3, 2009.
Notice of Allowance for U.S. Appl. No. 12/753,602 dated Aug. 25, 2011.
Extended European Search Report, Application No. 10165117.2-2304/2228227 dated Aug. 23, 2010.
Communication and Amendment to EPO for Application No. 03794123.4-2304 dated Jan. 5, 2009.
JPO Decision of Rejection on Japanese Application No. 2001-249838, with English Translation dated Jan. 11, 2011.
JPO Notification of Reason for Refusal on Japanese Application No. 2006-164724, with English Translation dated Nov. 24, 2009.
JPO Notification of Reason for Refusal on Japanese Application No. 2006-164724 with English Translation, dated Aug. 31, 2010.
Amendment for Japanese Application No. 2006-164724 with English Translation, dated Jan. 22, 2010.

CRT display screen example

| print paper | print mode | print resolution (dpi) | ON/OFF setting check boxes |
|---|---|---|---|
| normal paper | text characters | 360 × 360 | ○ ON ◉ OFF |
| | graph | 720 × 720 | ◉ ON ○ OFF |
| | photograph | 720 × 720 | ◉ ON ○ OFF |
| matte paper | text characters | 360 × 360 | ○ ON ◉ OFF |
| | graph | 720 × 720 | ◉ ON ○ OFF |
| | photograph | 1440 × 720 | ◉ ON ○ OFF |
| photograph paper | photograph | 1440 × 720 | ◉ ON ○ OFF |
| OHP paper | text characters | 360 × 360 | ○ ON ◉ OFF |
| | graph | 720 × 720 | ◉ ON ○ OFF |

FIG. 14 data table stored in a memory of computer 90

| print paper | print mode | ON/OFF setting check boxes |
|---|---|---|
| normal paper | text characters | OFF |
| | graph | ON |
| | photograph | ON |
| matte paper | text characters | OFF |
| | graph | ON |
| | photograph | ON |
| photograph paper | photograph | ON |
| OHP paper | text characters | OFF |
| | graph | ON |

FIG. 15

RECORDING APPARATUS, RECORDING METHOD, PROGRAM, AND COMPUTER SYSTEM

The present application is a Continuation application of application Ser. No. 10/521,318 filed Oct. 5, 2005, which is a National Stage of Application PCT/JP03/09945 filed Aug. 5, 2003 which claims priority from the Japanese Patent Application Nos. 2002-231213, filed Aug. 8, 2002, 2002-241016, filed Aug. 21, 2002, and 2002-241017, filed Aug. 21, 2002. The entire disclosures of these prior applications are hereby incorporated by reference in their entirety.

TECHNICAL FIELD

The present invention relates to recording apparatuses, recording methods, programs, and computer systems.

BACKGROUND ART

Inkjet printers that execute recording by intermittently ejecting a liquid are known as one example of recording apparatuses that record recording information by ejecting a liquid onto various types of recording media, including paper, cloth, and film. With such inkjet printers, images are recorded by repeating in alternation a process of positioning a recording medium by carrying it in the direction toward the recording head, and a process of ejecting liquid while moving the recording head in a direction that intersects the carrying direction of the recording medium.

(1) However, if, when recording the recording information on a recording medium, the width of the recording medium is shorter than the width, in the direction intersecting the carrying direction of the recording medium, over which the recording information is to be recorded, then the liquid that corresponds to the information, of the entire recording information, in the area that exceeds the width of the recording medium will be ejected onto the recording apparatus itself, causing the recording apparatus to become dirty and giving rise to a possibility that the recording medium will be wasted.

(2) Also, in recording apparatuses having carrying means for carrying a recording medium, setting means for setting the size of the recording medium, and a recording head for ejecting liquid to record recording information, when the width of the recording medium that has been loaded in the recording apparatus is different from a width of the size of the recording medium that has been set, then there is a possibility that the recording information cannot be properly recorded on the recording medium.

For example, if the width of the recording medium that has been loaded in the recording apparatus is shorter than a width of the size of said recording medium that has been set, then the liquid corresponding to the recording information in the area that exceeds the width of the recording medium will be ejected onto the recording apparatus itself, causing the recording apparatus to become dirty and giving rise to a possibility that the recording medium will be wasted. On the other hand, when the width of the recording medium that has been loaded in the recording apparatus is longer than a width of the size of said recording medium that has been set, then nonuniform margins that differ among the other edges of the recording medium are formed on the recording medium, and for example, when recording borderless recording information on the recording medium, there is a possibility that the recording medium will be wasted.

(3) Also, in recorded apparatuses provided with carrying means for carrying a recording medium, detection means that can move in a direction that intersects the carrying direction of the recording medium and that detects the width of the recording medium in the direction that intersects the carrying direction of the recording medium, and a recording head for ejecting liquid to record recording information, when the width of the recording medium that has been detected by the detection means is different from a preset recording medium width, then it is possible to stop recording of the recording information to the recording medium.

However, because the recording media used by the recording apparatus come in a wide variety of types and resolutions, there is a possibility that a problem will occur if the detection means is designed to detect the width of various recording media all in the same way. For example, if a user wishes to record low-resolution information (such as text characters) on an inexpensive recording medium (such as normal paper) in a short amount of time, then he/she may feel very inconvenienced by the amount of time that is required for the detection means to detect the width of the recording medium.

The present invention was arrived at in light of the foregoing issues, and it is an object thereof to achieve a recording apparatus, a recording method, a program, and a computer system with which recording media can be used effectively without the recording apparatus itself becoming dirty. It is a further object to achieve a recording apparatus, a recording method, a program, and a computer system with which recording information can be efficiently recorded to recording media.

DISCLOSURE OF INVENTION

A primary aspect of the invention for solving the foregoing issues is a recording apparatus comprising: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein if a width of the recording medium that has been detected by the detection means is shorter than a width, in the direction that intersects the carrying direction of the recording medium, over which the recording information is to be recorded, then a portion of the recording information, of the entire recording information, corresponding to the width, or to less than the width, of the recording medium that has been detected by the detection means is recorded onto the recording medium by the recording head.

Another primary aspect of the invention for solving the foregoing issues is a recording apparatus comprising: carrying means for carrying a recording medium; detection means that can move in a direction that intersects the carrying direction of the recording medium and that is for detecting a width of the recording medium in the direction that intersects the carrying direction of the recording medium; setting means for setting a size of the recording medium; and a recording head for ejecting liquid to record recording information; wherein a notice is made when the width of the recording medium that has been detected by the detection means is different from a width of the size of the recording medium that has been set with the setting means.

A yet further primary aspect of the invention for solving the foregoing issues is a recording apparatus comprising: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein ON/OFF of an operation through which the detection means detects the width of the recording medium is settable.

Other objects and features of the present invention will become clear through the accompanying drawings and the following description.

BRIEF DESCRIPTION OF DRAWINGS

FIG. 14 is an example of a display screen when setting, ON and OFF, the operation for the reflective optical sensor 29 to detect the width of the print paper P.

FIG. 15 is a data table showing the ON/OFF setting information on the display screen of FIG. 14.

Figure 1:
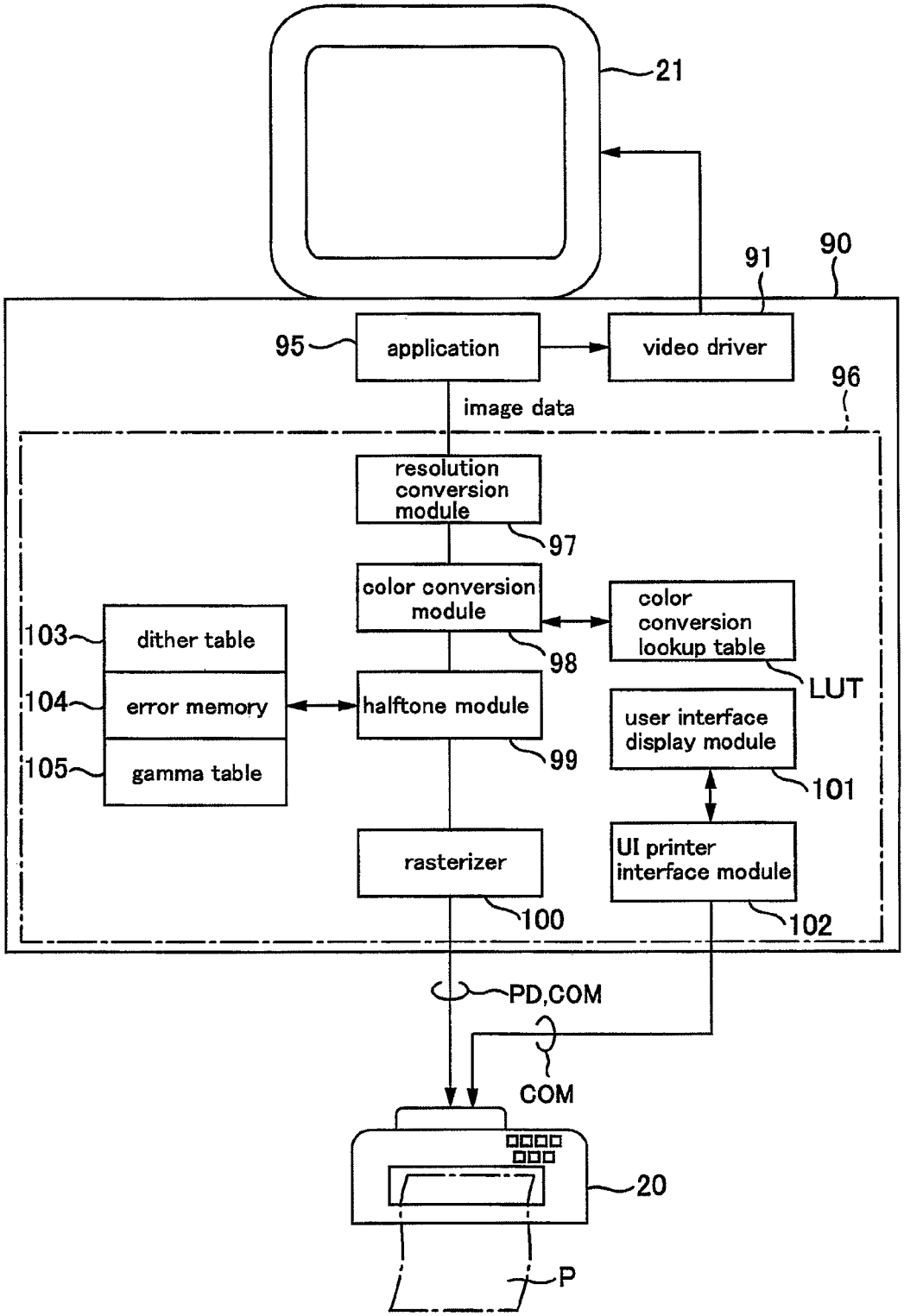
FIG. 1 is a block diagram showing an example of the configuration of a computer system having a recording apparatus of the present invention.

A legend of the main reference numerals used in the drawings is shown below.

11 linear encoder, 12 linear scale, 13 rotary encoder, 14 detecting section, 20 color inkjet printer, 21 CRT, 22 paper stacker, 24 paper feed roller, 25 pulley, 26 platen, 28 carriage, 29 reflective optical sensor, 30 carriage motor, 31 paper feed motor, 32 pull belt, 34 guide rail, 36 print head, 38 light-emitting member, 40 light-receiving member, 50 buffer memory, 52 image buffer, 54 system controller, 56 main memory, 57 RAM, 58 EEPROM, 61 main-scan drive circuit, 62 sub-scan drive circuit, 63 head drive circuit, 65 reflective optical sensor control circuit, 66 electric signal measuring section, 67 notice control circuit, 68 display panel, 69 speakers, 90 computer, 91 video driver, 95 application program, 96 printer driver, 97 resolution conversion module, 98 color conversion module, 99 halftone module, 100 rasterizer, 101 user interface display module, 102 UI printer interface module, 103 dither table, 104 error memory, 105 gamma table

BEST MODE FOR CARRYING OUT THE INVENTION

At least the following matters will be made clear by the explanation in the present specification and the description of the accompanying drawings.

A recording apparatus comprises: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein if a width of the recording medium that has been detected by the detection means is shorter than a width, in the direction that intersects the carrying direction of the recording medium, over which the recording information is to be recorded, then a portion of the recording information, of the entire recording information, corresponding to the width, or to less than the width, of the recording medium that has been detected by the detection means is recorded onto the recording medium by the recording head.

With this recording apparatus, the recording information, of the entire recording information, corresponding to the width, or to less than the width, of the recording medium is recorded to the recording medium by the recording head when the width of the recording medium is shorter than the width over which the recording information is to be recorded, and thus it is possible to prevent the recording apparatus from becoming dirty and the recording medium from being wasted.

Further, in the above recording apparatus, if the width of the recording medium that has been detected by the detection means is shorter than the width, in the direction that intersects the carrying direction of the recording medium, over which the recording information is to be recorded, then a portion of the recording information, of the entire recording information, corresponding to the width of the recording medium that has been detected by the detection means may be recorded onto the recording medium by the recording head.

With this recording apparatus, the recording information is recorded over the entire width of the recording medium, and thus it is possible to prevent the recording apparatus from becoming dirty due to the ejection of liquid, and, through the simple method of determining that the recording medium has been improperly loaded based on the information recorded on the recording medium, the recording medium can be prevented from being wasted.

Further, in the above recording apparatus, if the width of the recording medium that has been detected by the detection means is shorter than the width, in the direction that intersects the carrying direction of the recording medium, over which the recording information is to be recorded, then a portion of the recording information, of the entire recording information, corresponding to a width obtained by subtracting a border width from the width of the recording medium that has been detected by the detection means may be recorded onto the recording medium by the recording head.

With this recording apparatus, the recording information is recorded to the recording medium with a border added thereto, and thus it is possible to prevent the recording apparatus from becoming dirty due to the ejection of liquid, and, through the simple method of determining that the recording medium has been improperly loaded based on the information recorded on the recording medium, the recording medium can be effectively prevented from being wasted.

Further, in the above recording apparatus, the detection means may move in the direction that intersects the carrying direction of the recording medium and detect whether or not the recording medium is present, and detect the width of the recording medium based on whether or not the recording medium is present.

With this recording apparatus, it is possible to prevent the recording apparatus from becoming dirty and the recording medium from being wasted by using a detection means that detects the width of the recording medium based on whether or not the recording medium is present in a direction that intersects the carrying direction of the recording medium.

Further, in the above recording apparatus, the detection means and the recording head may both be provided in/on a moving member for moving in the direction that intersects the carrying direction of the recording medium.

With this recording apparatus, it is possible to prevent the recording apparatus from becoming dirty and the recording medium from being wasted by using a detection means that is provided along with the recording head in a moving member for moving in a direction that intersects the carrying direction of the recording medium.

Further, in the above recording apparatus, the detection means may have a light-emitting member for emitting light and a light-receiving member for receiving the light that is emitted by the light-emitting member, and may detect whether or not the recording medium is present based on an output value of the light-receiving member.

With this recording apparatus, it is possible to prevent the recording apparatus from becoming dirty and the recording medium from being wasted by using a detection means that has a light-emitting member for emitting light and a light-receiving member for receiving the light that is emitted by the light-emitting member.

It is also possible to achieve a recording apparatus comprising: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein if a width of the recording medium that has been detected by the detection means is shorter than a width, in the direction that intersects the carrying direction of the recording medium, over which the recording information is to be recorded, then a portion of the recording information, of the entire recording information, corresponding to the width, or to less than the width, of the recording medium that has been detected by the detection means is recorded onto the recording medium by the recording head; wherein if the width of the recording medium that has been detected by the detection means is shorter than the width, in the direction that intersects the carrying direction of the recording medium, over which the recording information is to be recorded, then a portion of the recording information, of the entire recording information, corresponding to the width of the recording medium that has been detected by the detection means, or a width obtained by subtracting a border width from the width of the recording medium that has been detected by the detection means is recorded onto the recording medium by the recording head; wherein the detection means moves in the direction that intersects the carrying direction of the recording medium and detects whether or not the recording medium is present, and detects the width of the recording medium based on whether or not the recording medium is present; wherein the detection means and the recording head are both provided in/on a moving member for moving in the direction that intersects the carrying direction of the recording medium; and wherein the detection means has a light-emitting member for emitting light and a light-receiving member for receiving the light that is emitted by the light-emitting member, and detects whether or not the recording medium is present based on an output value of the light-receiving member.

Further, a recording method for a recording apparatus that is provided with: a carrying mechanism for carrying a recording medium; a sensor that can move in a direction that intersects the carrying direction of the recording medium and that is for detecting a width of the recording medium in the direction that intersects the carrying direction of the recording medium; and a recording head for ejecting liquid to record recording information, comprises: recording, onto the recording medium using the recording head, a portion of the recording information, of the entire recording information, corresponding to the width, or to less than the width, of the recording medium that has been detected by the sensor, if a width of the recording medium that has been detected by the sensor is shorter than a width, in the direction that intersects the carrying direction of the recording medium, over which the recording information is to be recorded.

With this recording method, it is possible to prevent the recording apparatus from becoming dirty and the recording medium from being wasted.

Further, a program causes a recording apparatus provided with carrying means for carrying a recording medium, detection means that can move in a direction that intersects the carrying direction of the recording medium and that is for detecting a width of the recording medium in the direction that intersects the carrying direction of the recording medium, and a recording head for ejecting liquid to record recording information, to achieve the function of: recording, onto the recording medium using the recording head, a portion of the recording information, of the entire recording information, corresponding to the width, or to less than the width, of the recording medium that has been detected by the detection means, if a width of the recording medium that has been detected by the detection means is shorter than a width, in the direction that intersects the carrying direction of the recording medium, over which the recording information is to be recorded.

With this program, it is possible to perform control such that the recording medium can be used effectively without the recording apparatus itself becoming dirty.

It is also possible to achieve a computer-readable storage medium on which this program has been recorded.

It is also possible to achieve a computer system comprising: a recording apparatus including: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; and a main computer unit connected to the recording apparatus; wherein if a width of the recording medium that has been detected by the detection means is shorter than a width, in the direction that intersects the carrying direction of the recording medium, over which the recording information is to be recorded, then a portion of the recording information, of the entire recording information, corresponding to the width, or to less than the width, of the recording medium that has been detected by the detection means is recorded onto the recording medium by the recording head.

A recording apparatus comprises: carrying means for carrying a recording medium; detection means that can move in a direction that intersects the carrying direction of the recording medium and that is for detecting a width of the recording medium in the direction that intersects the carrying direction of the recording medium; setting means for setting a size of the recording medium; and a recording head for ejecting liquid to record recording information; wherein a notice is made when the width of the recording medium that has been detected by the detection means is different from a width of the size of the recording medium that has been set with the setting means.

With this recording apparatus, when the width of the recording medium that has been detected by the detection means is different from a width of the size of said recording medium that has been set through the setting means, then a notice is made to notify the user, and thus it is possible to prevent the recording apparatus from becoming dirty and the recording medium from being wasted.

Further, in the above recording apparatus, a notice may be made using audio information.

With this recording apparatus, a notice is made using audio information, and thus it is possible to effectively prevent the recording apparatus from becoming dirty and the recording medium from being wasted.

Further, in the above recording apparatus, a notice may be made using display information.

With this recording apparatus, a notice is made using display information, and thus it is possible to effectively prevent the recording apparatus from becoming dirty and the recording medium from being wasted.

Further, in the above recording apparatus, the recording apparatus may stop recording the recording information to the recording medium when the width of the recording medium that has been detected by the detection means is different from the width of the size of the recording medium that has been set with the setting means.

With this recording apparatus, the recording of recording information to the recording medium is stopped, and thus it is possible to effectively prevent the recording apparatus from becoming dirty and the recording medium from being wasted.

Further, in the above recording apparatus, at least the width of the size of the recording medium that has been set by the setting means may include a predetermined error, and a notice may be made when the width of the recording medium that has been detected by the detection means differs, by an amount of the error or more, from the width of the size of the recording medium that has been set by the setting means.

With this recording apparatus, the width of the recording medium that has been set includes some error, and thus even if discrepancies have occurred due to the manufacturing processes in the recording media that have been loaded in the recording apparatus, for example, the recording media are regarded as identical in size, allowing the recording apparatus to be effectively prevented from becoming dirty and the recording medium to be effectively prevented from being wasted.

Further, in the above recording apparatus, the detection means may move in the direction that intersects the carrying direction of the recording medium and detect the width of the recording medium based on whether or not the recording medium is present.

With this recording apparatus, it is possible to prevent the recording apparatus from becoming dirty and the recording medium from being wasted by using a detection means that detects the width of the recording medium based on whether or not the recording medium is present in a direction that intersects the carrying direction of the recording medium.

Further, in the above recording apparatus, the detection means and the recording head may both be provided in/on a moving member for moving in the direction that intersects the carrying direction of the recording medium.

With this recording apparatus, it is possible to prevent the recording apparatus from becoming dirty and the recording medium from being wasted by using a detection means that is provided along with the recording head in a moving member for moving in a direction that intersects the carrying direction of the recording medium.

Further, in the above recording apparatus, the detection means may have a light-emitting member for emitting light and a light-receiving member for receiving the light that is emitted by the light-emitting member, and detect whether or not the recording medium is present based on an output value of the light-receiving member.

With this recording apparatus, it is possible to prevent the recording apparatus from becoming dirty and the recording medium from being wasted by using a detection means that has a light-emitting member for emitting light and a light-receiving member for receiving the light that is emitted by the light-emitting member.

It is also possible to achieve a recording apparatus comprising: carrying means for carrying a recording medium; detection means that can move in a direction that intersects the carrying direction of the recording medium and that is for detecting a width of the recording medium in the direction that intersects the carrying direction of the recording medium; setting means for setting a size of the recording medium; and a recording head for ejecting liquid to record recording information; wherein a notice is made using audio information or display information when the width of the recording medium that has been detected by the detection means is different from a width of the size of the recording medium that has been set with the setting means; wherein the recording apparatus stops recording the recording information to the recording medium when the width of the recording medium that has been detected by the detection means is different from the width of the size of the recording medium that has been set with the setting means; wherein the width of the size of the recording medium that has been set by the setting means includes a predetermined error, and a notice is made when the width of the recording medium that has been detected by the detection means differs, by an amount of the error or more, from the width of the size of the recording medium that has been set by the setting means; wherein the detection means moves in the direction that intersects the carrying direction of the recording medium and detects the width of the recording medium based on whether or not the recording medium is present; wherein the detection means and the recording head are both provided in/on a moving member for moving in the direction that intersects the carrying direction of the recording medium; and wherein the detection means has a light-emitting member for emitting light and a light-receiving member for receiving the light that is emitted by the light-emitting member, and detects whether or not the recording medium is present based on an output value of the light-receiving member.

Further, a recording method for a recording apparatus that is provided with: a carrying mechanism for carrying a recording medium; a sensor that can move in a direction that intersects the carrying direction of the recording medium and that is for detecting a width of the recording medium in the direction that intersects the carrying direction of the recording medium; a setting section for setting a size of the recording medium; and a recording head for ejecting liquid to record recording information, comprises: making a notice when the width of the recording medium that has been detected by the sensor is different from a width of the size of the recording medium that has been set with the setting section.

With this recording method, it is possible to prevent the recording apparatus from becoming dirty and the recording medium from being wasted.

Further, a program causes a recording apparatus provided with carrying means for carrying a recording medium, detection means that can move in a direction that intersects the carrying direction of the recording medium and that is for detecting a width of the recording medium in the direction that intersects the carrying direction of the recording medium, setting means for setting a size of the recording medium, and a recording head for ejecting liquid to record recording information, to achieve the function of: making a notice when the width of the recording medium that has been detected by the detection means is different from a width of the size of the recording medium that has been set with the setting means.

With this program, it is possible to perform control such that the recording medium can be used effectively without the recording apparatus itself becoming dirty.

It is also possible to achieve a computer-readable storage medium on which this program has been recorded.

It is also possible to achieve a computer system comprising: a recording apparatus including: carrying means for carrying a recording medium; detection means that can move in a direction that intersects the carrying direction of the recording medium and that is for detecting a width of the recording medium in the direction that intersects the carrying direction of the recording medium; setting means for setting a size of the recording medium; and a recording head for ejecting liquid to record recording information; and a main computer unit connected to the recording apparatus; wherein a notice is made when the width of the recording medium that has been detected by the detection means is different from a width of the size of the recording medium that has been set with the setting means.

A recording apparatus comprises: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein ON/OFF of an operation through which the detection means detects the width of the recording medium is settable.

With this recording apparatus, it is possible to set the operation by which the detection means detects the width of the recording medium ON and OFF, and thus the recording information can be efficiently recorded to the recording medium.

Further, in the above recording apparatus, the ON/OFF of the operation through which the detection means detects the width of the recording medium may be settable through a display screen.

With this recording apparatus, the operation through which the detection means detects the width of the recording medium can be set to ON or OFF on a display screen, and thus the setting information can be reliably confirmed and the recording information can be efficiently recorded to the recording medium.

Further, in the above recording apparatus, the ON/OFF of the operation through which the detection means detects the width of the recording medium may be initially set to either one of ON and OFF in accordance with a type of the recording medium.

With this recording apparatus, the operation through which the detection means detects a width of the recording medium is initially set to either one of ON and OFF in accordance with a type of the recording medium, and thus it is not necessary for the user to perform an initial setting, and this allows the recording information to be efficiently recorded to the recording medium.

Further, in the above recording apparatus, the ON/OFF of the operation through which the detection means detects the width of the recording medium may be initially set to either one of ON and OFF in accordance with a resolution at which the recording information is to be recorded to the recording medium.

With this recording apparatus, the operation through which the detection means detects a width of the recording medium is initially set to either one of ON and OFF in accordance with a resolution at which the recording information is to be recorded to the recording medium, and thus it is not necessary for the user to perform an initial setting, and this allows the recording information to be efficiently recorded to the recording medium.

Further, in the above recording apparatus, the recording apparatus may further comprise setting means for setting a size of the recording medium; and a notice may be made when the width of the recording medium that has been detected by the detection means is different from a width of the size of the recording medium that has been set with the setting means.

With this recording apparatus, a notice is made to notify the user that the size of the recording apparatus is incorrect when the width of the recording apparatus that has been detected by the detection means is different from a width of the size of the recording medium that has been set with the setting means, and thus the recording information can be efficiently recorded to a recording medium of an appropriate size.

Further, in the above recording apparatus, the detection means may detect the width of the recording medium before the recording head starts the recording of the recording information to the recording medium.

With this recording apparatus, the width of the recording medium is detected before the recording head starts the recording of recording information to a recording medium, and thus the recording medium is prevented from being wasted, and this allows the recording information to be efficiently recorded to a recording medium of an appropriate size.

Further, in the above recording apparatus, the detection means may move in the direction that intersects the carrying direction of the recording medium and detect the width of the recording medium based on whether or not the recording medium is present.

With this recording apparatus, recording information can be efficiently recorded to recording media by using a detection means that detects the width of the recording medium based on whether or not the recording medium is present in a direction that intersects the carrying direction of the recording medium.

Further, in the above recording apparatus, the detection means and the recording head may both be provided in/on a moving member for moving in the direction that intersects the carrying direction of the recording medium.

With this recording apparatus, recording information can be efficiently recorded to recording media by using a detection means that is provided along with the recording head in a moving member for moving in a direction that intersects the carrying direction of the recording medium.

Further, in the above recording apparatus, the detection means may have a light-emitting member for emitting light and a light-receiving member for receiving the light that is emitted by the light-emitting member, and detect whether or not the recording medium is present based on an output value of the light-receiving member.

With this recording apparatus, recording information can be efficiently recorded to recording media by using a detection means that has a light-emitting member for emitting light and a light-receiving member for receiving the light that is emitted by the light-emitting member.

It is also possible to achieve a recording apparatus comprising: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; wherein ON/OFF of an operation through which the detection means detects the width of the recording medium is settable through a display screen; wherein the ON/OFF of the operation through which the detection means detects the width of the recording medium is initially set to either one of ON and OFF in accordance with a type of the recording medium or a resolution at which the recording information is to be recorded to the recording medium; wherein the recording apparatus further comprises setting means for setting a size of the recording medium; wherein a notice is made when the width of the recording medium that has been detected by the detection means is different from a width of the size of the recording medium that has been set with the setting means; wherein, before the recording head starts the recording of the recording information to the recording medium, the detection means moves in the direction that intersects the carrying direction of the recording medium and detects the width of the recording medium based on whether or not the recording medium is present; wherein the detection means and the recording head are both provided in/on a moving member for moving in the direction that intersects the carrying direction of the recording medium; and wherein the detection means has a light-emitting member for emitting light and a light-receiving member for receiving the light that is emitted by the light-emitting member, and detects whether or not the recording medium is present based on an output value of the light-receiving member.

Further, a recording method for a recording apparatus that is provided with: a carrying mechanism for carrying a recording medium; a sensor that can move in a direction that intersects the carrying direction of the recording medium and that is for detecting a width of the recording medium in the direction that intersects the carrying direction of the recording medium; and a recording head for ejecting liquid to record recording information, comprises: enabling ON/OFF of an operation through which the sensor detects the width of the recording medium to be settable.

With this recording method, it is possible to set the operation through which the detection means detects the width of the recording medium to ON or OFF, and as a result it is possible to efficiently record the recording information to a recording medium.

Further, a program causes a recording apparatus provided with carrying means for carrying a recording medium, detection means that can move in a direction that intersects the carrying direction of the recording medium and that is for detecting a width of the recording medium in the direction that intersects the carrying direction of the recording medium, and a recording head for ejecting liquid to record recording information, to achieve the function of: enabling ON/OFF of an operation through which the detection means detects the width of the recording medium to be settable.

With this program, it is possible to perform control such that the operation through which the detection means detects the width of the recording medium can be set to ON or OFF, and thus the recording information can be efficiently recorded to recording media.

It is also possible to achieve a computer-readable storage medium on which this program has been recorded.

It is also possible to achieve a computer system comprising: a recording apparatus including: carrying means for carrying a recording medium; detection means that can move in a direction that intersects the carrying direction of the recording medium and that is for detecting a width of the recording medium in the direction that intersects the carrying direction of the recording medium; and a recording head for ejecting liquid to record recording information; and a main computer unit connected to the recording apparatus; wherein ON/OFF of an operation through which the detection means detects the width of the recording medium is settable.

—Configuration Example of Computer System—

FIG. 1 is a block diagram showing a configuration example of a computer system having the recording apparatus of the present invention. The computer system in FIG. 1 is made of a color inkjet printer 20, a computer 90, a display device (a CRT 21 or a liquid crystal display, for example, that is not shown), an input device (a keyboard or mouse, for example, that is not shown), and a drive device (a flexible drive device or CD-ROM drive device, for example, that is not shown). It should be noted that in this embodiment, the recording apparatus is made of the color inkjet printer 20 and a printer driver 96 inside the computer 90. Here, the recording apparatus may also be configured incorporating the printer driver 96 within the color inkjet printer 20. It is also possible for the color inkjet printer 20 to serve as the recording apparatus.

The computer 90 has a video driver 91 for driving the CRT 21 to perform displaying, the printer driver 96 for driving the color inkjet printer 20 to perform printing, and an application program 95 for driving and controlling the video driver 91 and the printer driver 96. The video driver 91 appropriately processes the image data to be processed in accordance with a display command from the application program 95, and then supplies the data to the CRT 21. The CRT 21 displays an image that corresponds to the image data supplied from the video driver 91. Also, the printer driver 96 suitably processes, in accordance with a print command from the application program 95, the image data to be processed and supplies these to the color inkjet printer 20 as print data PD. Operation of the video driver 91, the printer driver 96, and the application program 95 is controlled by an operating system OS (not shown) provided in advance within the computer 90.

<Configuration Example of the Printer Driver 96>

The printer driver 96 is provided with a resolution conversion module 97, a color conversion module 98, a halftone module 99, a dither table 103, an error memory 104, a gamma table 105, a rasterizer 100, a user interface display module 101, a UI printer interface module 102, and a color conversion lookup table LUT.

The resolution conversion module 97 converts image data (character data in an outline font, illustration data, etc.) specified by a user and output from the application program 95 into color image data of a resolution for printing on a print paper P. It should be noted that the color image data resulting from this conversion by the resolution conversion module 97 are data of the RGB color system made of color components of the three primary colors of RGB.

The color conversion lookup table LUT is for correlating the conversion relationship between the data of the RGB color system that has been output from the resolution conversion module 97 and data of the CMYK color system. The color conversion module 98 references the color conversion lookup table LUT and, for each pixel, converts the RGB color image data that is output from the resolution conversion module 97 into multi-gradation data of a plurality of ink colors that can be used by the color inkjet printer 20. It should be noted that the multi-gradation data that have been converted by the color conversion module 98 have a gradation value of 256 gradations, for example.

The halftone module 99, performs halftone processing on multi-gradation data that is output from the color conversion module 98 by referencing the dither table 103 for performing dithering or the gamma table 105 for performing gamma correction, or using the error memory 104 for storing diffused error when performing error diffusion, thereby generating halftone image data as pixel data. It should be noted that the CMYK halftone image data is binary data in which, on a pixel-by-pixel basis, the logic value is "1" if a dot is to be displayed and the logic value is "0" if a dot is not to be displayed.

The rasterizer 100 arranges the binary halftone image data obtained from the halftone module 99 into a data sequence to be supplied to the color inkjet printer 20, and supplies this to the color inkjet printer 20 as the print data PD. It should be noted that the print data PD includes raster data that indicates the manner in which dots are formed when the print head moves in the main-scanning direction, and data that indicates the carry amount for which the print medium is successively moved in the sub-scanning direction, which intersects the main-scanning direction.

The user interface display module 101 has a function for displaying various windows related to printing, and a function for receiving instructions input by the user through these windows.

The UI printer interface module 102 is interposed between the user interface display module 101 and the color inkjet printer 20, and performs bi-directional interfacing. That is, when a user gives an instruction on the user interface display module 101, the UI printer interface module 102 serves as an interface in the direction in which various commands COM, which are obtained by interpreting orders from the user interface display module 101, are supplied to the color inkjet printer 20. The UI printer interface module 102 also serves as an interface in the direction in which various commands COM from the color inkjet printer 20 are supplied to the user interface display module 101.

In this way, the printer driver 96 achieves a function for supplying print data PD to the color inkjet printer 20 and a function for inputting and outputting various commands COM between itself and the color inkjet printer 20. It should be noted that a program for achieving the functions of the printer driver 96 is supplied to the computer 90 recorded on various media, which serve as computer-readable storage media, such as flexible disks, CD-ROMs, magneto optical disks, IC cards, ROM cartridges, punch cards, printed materials on which a code such as a barcode is printed, and internal storage devices and external storage devices of the computer. Further, a program for achieving the functions of the printer driver 96 can be downloaded onto the computer 90 from a WWW (World Wide Web) server or the like publicly available on the Internet.

—Configuration Example of the Recording Apparatus (Inkjet Printer)—

Figure 2:
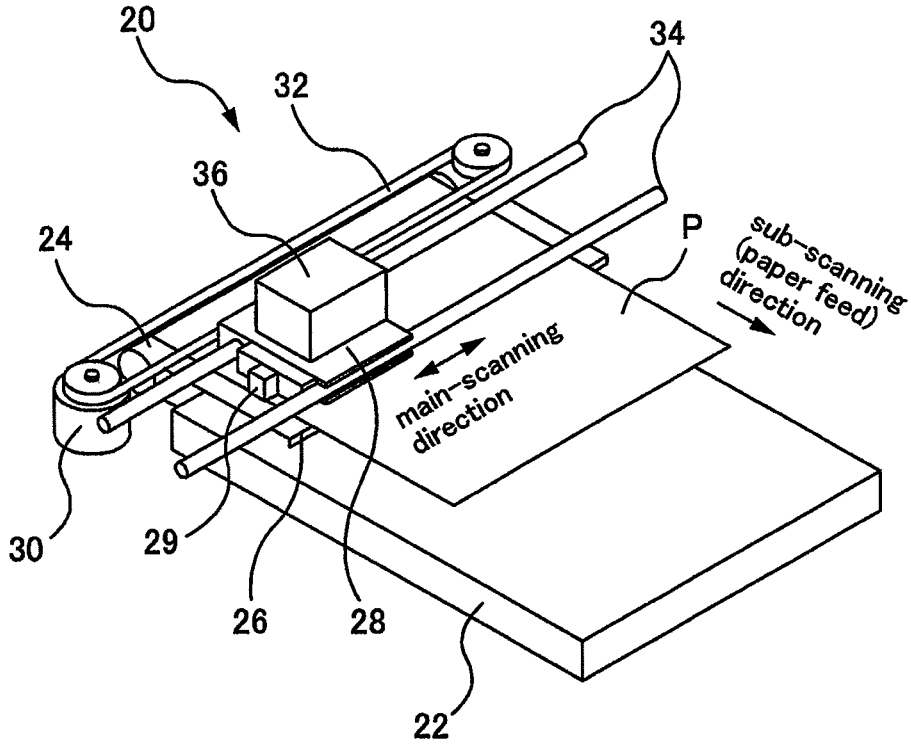
FIG. 2 is a perspective view schematically showing an example of the principal configuration of the color inkjet printer 20 shown in FIG. 1.

FIG. 2 is a perspective view schematically showing an example of a primary configuration of the color inkjet printer 20 shown in FIG. 1. The color inkjet printer 20 is provided with a paper stacker 22, a paper feed roller 24 driven by a step motor (not shown), a platen 26, a carriage 28 serving as a moving member, a carriage motor 30, a pull belt 32 for transmitting the drive force of the carriage motor 30, and guide rails 34 for guiding the carriage 28. Also, the carriage 28 is provided with a print head 36 that has numerous nozzles for forming dots, and a reflective optical sensor 29 serving as a light-emitting member and a light-receiving member, which will be discussed later.

The carriage 28 is pulled by the pull belt 32, which transmits the drive force of the carriage motor 30, and is moved in the main-scanning direction shown in FIG. 2 along the guide rails 34. The print paper P is drawn out from the paper stacker 22, rolled out by the paper feed roller 24, and then carried over the surface of the platen 26 in a vertical sub-scanning direction, which intersects the main-scanning direction shown in FIG. 2. It should be noted that the paper feed roller 24, which serves as carrying means (carrying mechanism), is driven when the operation for supplying the print paper P from the paper stacker 22 onto the platen 26 and the operation for discharging the print paper P from the platen 26 are performed.

—Configuration Example of the Detection Means (Reflective Optical Sensor)—

Figure 3:
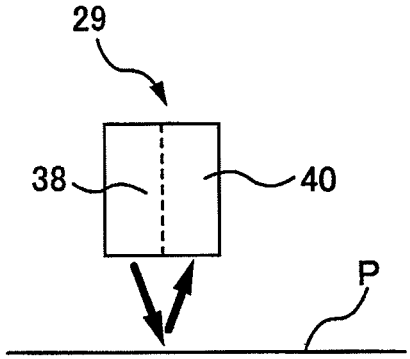
FIG. 3 is a schematic diagram for describing an example of the reflective optical sensor 29 provided in the carriage 28.

FIG. 3 is a schematic diagram for describing an example of the reflective optical sensor 29 provided in the carriage 28. The reflective optical sensor 29 has a light-emitting member 38 such as a light-emitting diode that emits light, and a light-receiving member 40 such as a phototransistor that receives the light emitted by the light-emitting member, and although it is for detecting the width of the print paper P in the main-scanning direction and the upper edge of the print paper P in the sub-scanning direction, it is instead possible to provide separate reflective optical sensors for detecting these. It should be noted that the light-emitting member 38 is not limited to the above-mentioned light-emitting diode, and as long as it is a member that is capable of constituting an element for achieving the present invention by emitting light, any such member may be employed. Also, the light-receiving member 40 is not limited to the above-mentioned phototransistor, and as long as it is a member that is capable of constituting an element for achieving the present invention by receiving the light from the light-emitting member 38, any such member may be employed.

The incident light, which has directivity, that is emitted by the light-emitting member 38 is irradiated onto the print paper P if the print paper P is present in the incidence direction. On the other hand, if the print paper P is not present in the incidence direction, then the light is irradiated onto the platen 26. The incident light that is emitted onto the print paper P or the platen 26 is reflected. The light that is reflected at this time is received by the light-receiving member 40 and is converted into an electric signal that serves as an output value corresponding to the intensity of the reflected light. In other words, the intensity of the light reflected by the print paper P and the platen 26 is different, and thus whether or not the print paper P is present in the incidence direction of the reflective optical sensor 29 can be determined according to the intensity of the electric signal obtained from the light-receiving member 40. The intensity of the electric signal obtained from the light-receiving member 40 is measured by an electric signal measuring section 66 that will be described later.

It should be noted that in this embodiment, the reflective optical sensor 29 is provided as a single unit incorporating the light-emitting member 38 and the light-receiving member 40, but the present invention is not limited to this configuration. That is, it is also possible to adopt a configuration in which the light-emitting member 38 and the light-receiving member are separate members making up the reflective optical sensor 29, and the reflective optical sensor 29 is provided in the carriage 28.

Further, in this embodiment, an electric signal that corresponds to the intensity of the reflected light obtained by the light-receiving member 40 is measured, but this is not a limitation. That is, it is also possible to provide means capable of measuring the intensity of the reflected light that is received by the light-receiving member 40 other than as an electric signal.

The reflective optical sensor 29 is provided in the carriage 28 at a position on the upstream side when the print paper P is carried in the sub-scanning direction. For example, in FIG. 8, the reflective optical sensor 29 is provided to the left of the black nozzle #180 of the print head 36.

—Configuration Example of the Carriage Area—

Figure 4:
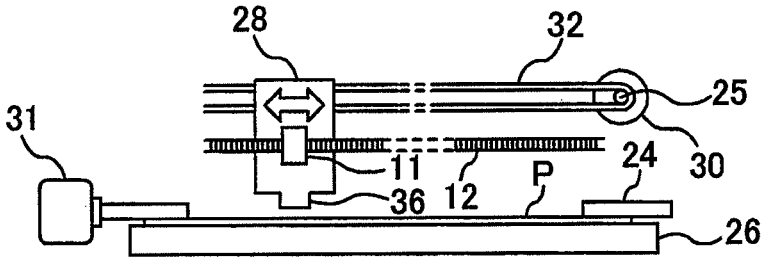
FIG. 4 is a diagram showing an example of the structure in the periphery of the carriage 28 of the color inkjet printer 20.

FIG. 4 is a diagram showing an example of the configuration in the periphery of the carriage 28 of the color inkjet printer 20. The color inkjet printer 20 is provided with a paper feed motor (hereafter "PF motor") 31 for carrying the print paper P, the carriage 28 to which the print head 36 for ejecting ink onto the print paper P is provided and which moves in the main-scanning direction, the carriage motor (hereafter "CR motor") 30 for driving the carriage 28, a linear encoder 11 that is provided in the carriage 28, a linear scale 12 in which slits are formed at a predetermined spacing, the platen 26 for supporting the print paper P, the paper feed roller 24 that receives the drive force conveyed from the PF motor 31 and carries the print paper P in the sub-scanning direction, a rotary encoder 13 (see FIG. 7) for detecting the amount of rotation of the paper feed roller 24, a pulley 25 arranged at the rotational shaft of the CR motor 30, and the pull belt 32, which spans over the pulley 25.

—Configuration Example of the Encoder—

Figure 5:
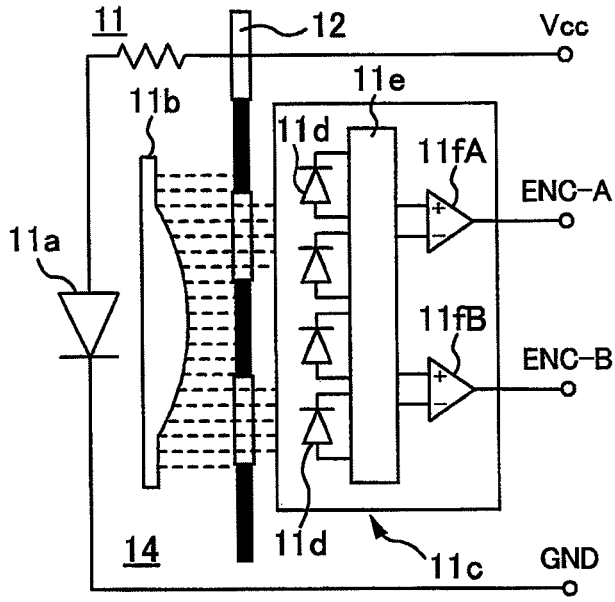
FIG. 5 is an explanatory diagram of a linear encoder 11.

FIG. 5 is an explanatory diagram of the linear encoder 11.

The linear encoder 11 is for detecting the position of the carriage 28, and has a linear scale 12 and a detecting section 14.

The linear scale 12 is provided with slits at a predetermined spacing (for example, every 1/180 inch (1 inch =2.54 cm)), and is fastened to the main printer unit side. The detecting section 14 is provided in opposition to the linear scale 12, and is on the carriage 28 side. The detecting section 14 has a light-emitting diode 11*a*, a collimating lens 11*b*, and a detection processing section 11*c*. The detection processing section 11*c* is provided with a plurality of (for instance, four) photodiodes 11*d*, a signal processing circuit 11*e*, and two comparators 11*f*A and 11*f*B.

The light-emitting diode 11*a* emits light when a voltage Vcc is applied to it via a resistor on the anode side, and this light is incident on the collimating lens 11*b*. The collimating lens 11*b* turns the light that is emitted from the light-emitting diode 11*a* into parallel light, and irradiates the parallel light onto the linear scale 12. The parallel light that passes through the slits provided in the linear scale 12 then passes through stationary slits (not shown) and is incident on the photodiodes 11*d*. The photodiodes 11*d* convert the incident light into electric signals. The electric signals that are output from the photodiodes 11*d* are compared in the comparators 11*f*A and 11*f*B, and the results of these comparisons are output as pulses. The pulse ENC-A and the pulse ENC-B that are output from the comparators 11*f*A and 11*f*B become the output of the linear encoder 11.

Figure 6:
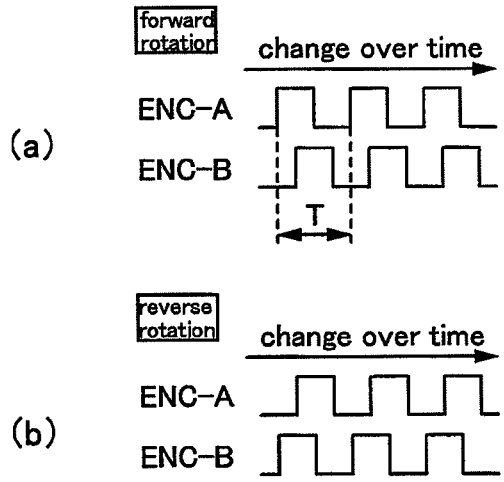
FIGS. 6(*a*) and 6(*b*) are timing charts showing the waveforms of the two types of output signals of the linear encoder 11.

FIG. 6 is a timing chart showing the waveforms of the two types of output signals of the linear encoder 11. FIG. 6(*a*) is a timing chart of the waveform of the output signal when the CR motor 30 is rotating forward. FIG. 6(*b*) is a timing chart showing the waveform of the output signal when the CR motor 30 is rotating in reverse.

As shown in FIG. 6(*a*) and FIG. 6(*b*), the phases of the pulse ENC-A and the pulse ENC-B are misaligned by 90 degrees both when the CR motor 30 is rotating forward and when it is rotating in reverse. When the CR motor 30 is rotating forward, that is, when the carriage 28 is moving in the main-scanning direction, then, as shown in FIG. 6(*a*), the phase of the pulse ENC-A leads the phase of the pulse ENC-B by 90 degrees. On the other hand, when the CR motor 30 is rotating in reverse, then, as shown in FIG. 6(*b*), the phase of the pulse ENC-A trails the phase of the pulse ENC-B by 90 degrees. A single period T of the pulses is equivalent to the time during which the carriage 28 is moved by the spacing of the slits of the linear scale 12 (for example, by 1/180 inch (1 inch=2.54 cm)).

The position of the carriage 28 is detected as follows. First, the rising edge or the falling edge of either the pulse ENC-A or ENC-B is detected, and the number of detected edges is counted. The position of the carriage 28 is calculated based on the counted number. As regards the counted number, when the CR motor 30 is rotating forward, a "+1" is added for each detected edge, and when the CR motor 30 is rotating in reverse, a "−1" is added for each detected edge. Since the period of the pulses ENC is equal to the slit spacing of the linear scale 12, by multiplying the counted number and the slit spacing, it is possible to obtain the amount that the carriage 28 has moved from the position for when the count number was "0". In other words, the resolution of the linear encoder 11 in this case is the slit spacing of the linear scale 12. It is instead possible to detect the position of the carriage 28 using both the pulse ENC-A and the pulse ENC-B. The periods of the pulse ENC-A and the pulse ENC-B are equal to the slit spacing of the linear scale 12, and the phases of the pulses ENC-A and ENC-B are misaligned by 90 degrees, so that if the rising edges and the falling edges of the pulses are detected and the number of detected edges is counted, then a counted number of "1" corresponds to ¼ of the slit spacing of the linear scale 12. Therefore, by multiplying the counted number and ¼ of the slit spacing, it is possible to obtain the amount that the carriage 28 has moved from the position for when the count number was "0". That is, the resolution of the linear encoder 11 in this case is ¼ the slit spacing of the linear scale 12.

The velocity Vc of the carriage 28 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. If λ is the slit spacing of the linear scale 12, then the velocity of the carriage can be sequentially obtained as λ/T. It is instead possible to detect the velocity of the carriage 28 using both the pulse ENC-A and the pulse ENC-B. By detecting the rising edges and the falling edges of the pulses, the time interval between edges, which corresponds to ¼ of the slit spacing of the linear scale 12, is counted by the timer counter. The period T (T=T1, T2, . . . ) is obtained from the value that is counted. If λ is the slit spacing of the linear scale 12, then the velocity Vc of the carriage can be found sequentially as Vc=λ/(4T).

It should be noted that the rotary encoder 13 has substantially the same configuration as the linear encoder 11, except that a rotation disk (not shown) that rotates in conjunction with rotation of the paper feed roller 24 is used in place of the linear scale 12 provided on the main printer unit side, and that a detecting section (not shown) provided on the main printer unit is used in place of the detecting section 14 that is provided on the carriage 28.

The rotary encoder 13 detects the rotation amount of the paper feed roller 24, and does not directly detect the carry amount of the print paper P. However, when the paper feed roller 24 is rotated and carries the print paper P, a carry error occurs due to slippage between the paper feed roller 24 and the print paper P. Therefore, the rotary encoder 13 cannot directly detect the carry error of the carry amount of the print paper P. Accordingly, a table (not shown) that expresses the relationship between the rotation amount of the paper feed roller 24 that is detected by the rotary encoder 13 and the carry error of the carry amount of the print paper P is created, and this table is stored in a memory of the main printer unit. Then, the corresponding carry error from the table is referenced based on the rotation amount of the paper feed roller 24 detected by the rotary encoder 13, and correction is performed to eliminate the carry error. It should be noted that the table is not limited to expressing the relationship between the rotation amount of the paper feed roller 24 and the carry error of the carry amount of the print paper P, and it can also express the relationship between the number of carries of the print paper P and the carry error. Also, because slippage between the paper feed roller 24 and the print paper P differs depending on the type of paper, it is also possible to store, in the memory, tables corresponding to paper types. Considering the possibility that the table data may be updated at a future time, it is preferable that an EEPROM, to which data can be rewritten electrically, is used as the memory for storing the table.

—Example of the Electrical Configuration of the Recording Apparatus (Color Inkjet Printer)—

Figure 7:
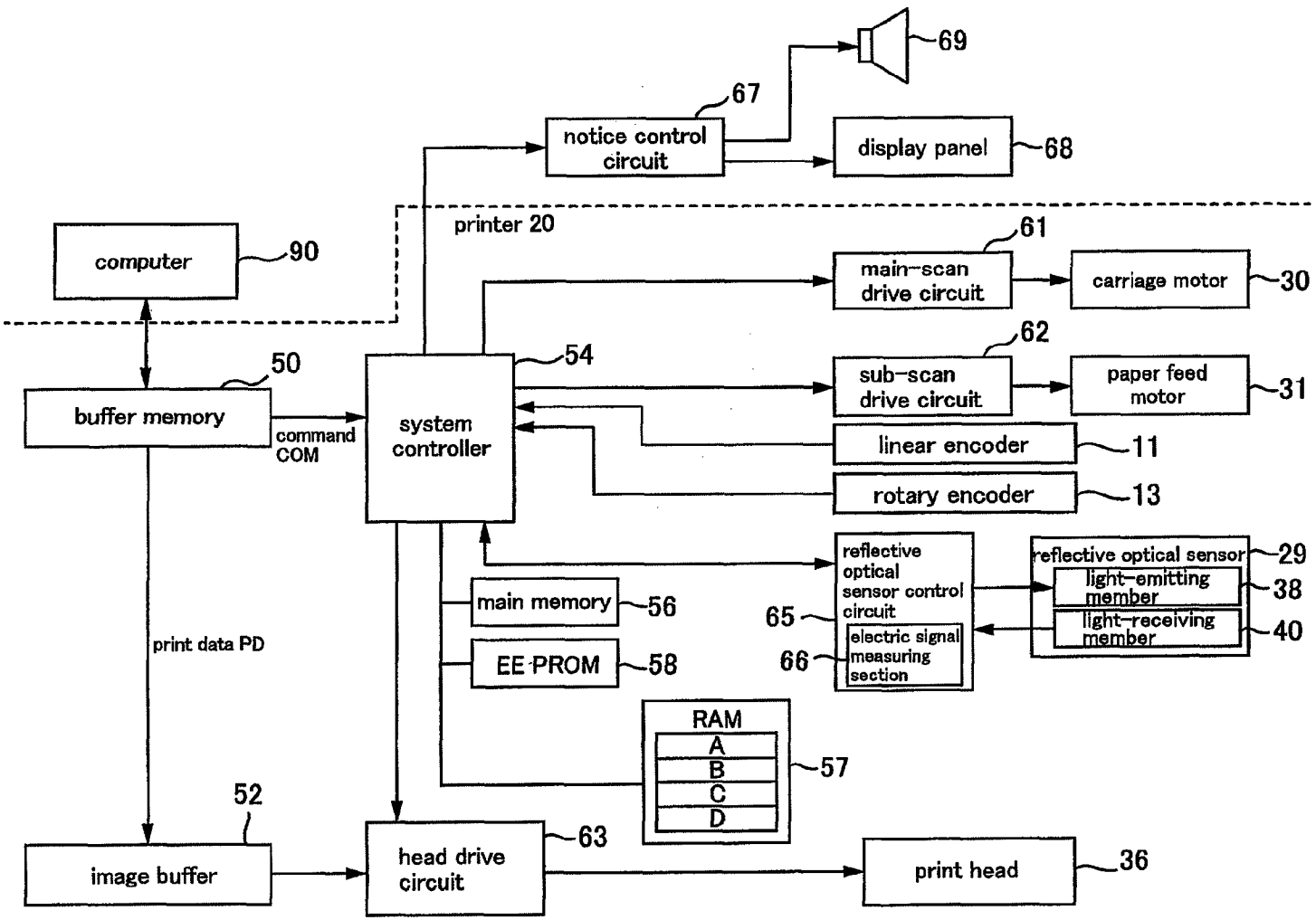
FIG. 7 is a block diagram showing an example of the electrical configuration of the color inkjet printer 20.

FIG. 7 is a block diagram showing an example of the electrical configuration of the color inkjet printer 20. In the color inkjet printer 20, a buffer memory 50 is provided to temporarily store signals supplied from the computer 90. An image buffer 52 is supplied with the print data PD temporarily stored in the buffer memory 50. A system controller 54 is supplied with the various commands COM temporarily stored in the buffer memory 50.

A main memory 56 is connected to the system controller 54 and is stored, in beforehand, with data such as program data for controlling the operation of the color inkjet printer 20 regardless of the interface between the computer 90 and the buffer memory 50, and table data that are referenced when controlling the operation of the color inkjet printer 20. It should be noted that either a nonvolatile storage element (such as a mask ROM to which data are permanently recorded during the manufacturing process, an EPROM in which data can be erased by ultraviolet light, or an EEPROM to which data can be rewritten electrically) or a volatile storage element (such as an SRAM that can hold data through a backup power source) may be employed as the main memory 56, but it is preferable that a nonvolatile storage element is used so as to ensure that the data are held.

An EEPROM 58 rewrites and stores information, such as the remaining ink amount, that changes every time the print operation is executed, and is connected to the system controller 54.

Moreover, the system controller 54 is connected to a RAM 57 that stores task data, a main-scan drive circuit 61 for driving the CR motor 30, a sub-scan drive circuit 62 for driving the PF motor 31, a head drive circuit 63 for driving the print head 36, a reflective optical sensor control circuit 65 for controlling the light-emitting member 38 and the light-receiving member 40, which constitute the reflective optical sensor 29, the linear encoder 11, and the rotary encoder 13. It should be noted that the reflective optical sensor control circuit 65 has an electric signal measuring section 66 for measuring the electric signals that correspond to the intensity of the reflected light obtained from the light-receiving member 40.

Thus, the system controller 54 interprets the various commands COM that are supplied from the buffer memory 50, and appropriately supplies control signals obtained from the result of this interpretation to the main-scan drive circuit 61, the sub-scan drive circuit 62, and the head drive circuit 63, for example. In particular, the head drive circuit 63 reads out the color components that make up the print data PD from the image buffer 52 in accordance with the control signals supplied from the system controller 54, and drives the nozzle array for each color (black, yellow, magenta, and cyan) of the print head 36 in correspondence with the respective color components.

A notice control circuit 67 is connected to the system controller 54, and outputs control signals for making various notices. For example, it can be set so as to output a control signal for making a notice when the width of the print paper P that is provided in the color inkjet printer 20 is different from the width of the size of the print paper that has been set with the user interface display module 101. In this case, the notice control circuit 67 is capable of outputting at least one of a notice control signal for display and for audio in accordance with the output of the system controller 54 when it has received the measurement results of the electric signal measuring section 66 of the reflective optical sensor control circuit 65.

The display panel 68 receives a display-notice control signal, and performs various types of displays. For example, it can display a message such as "Print paper size is incorrect." The display panel 68 is made, for example, of an LCD or organic EL. A speaker 69 emits a sound when supplied with an audio-notice control signal. It should be noted that a unit separate from the color inkjet printer 20 may be used for the speaker 69.

—Example of the Print Head Nozzle Arrangement—

Figure 8:
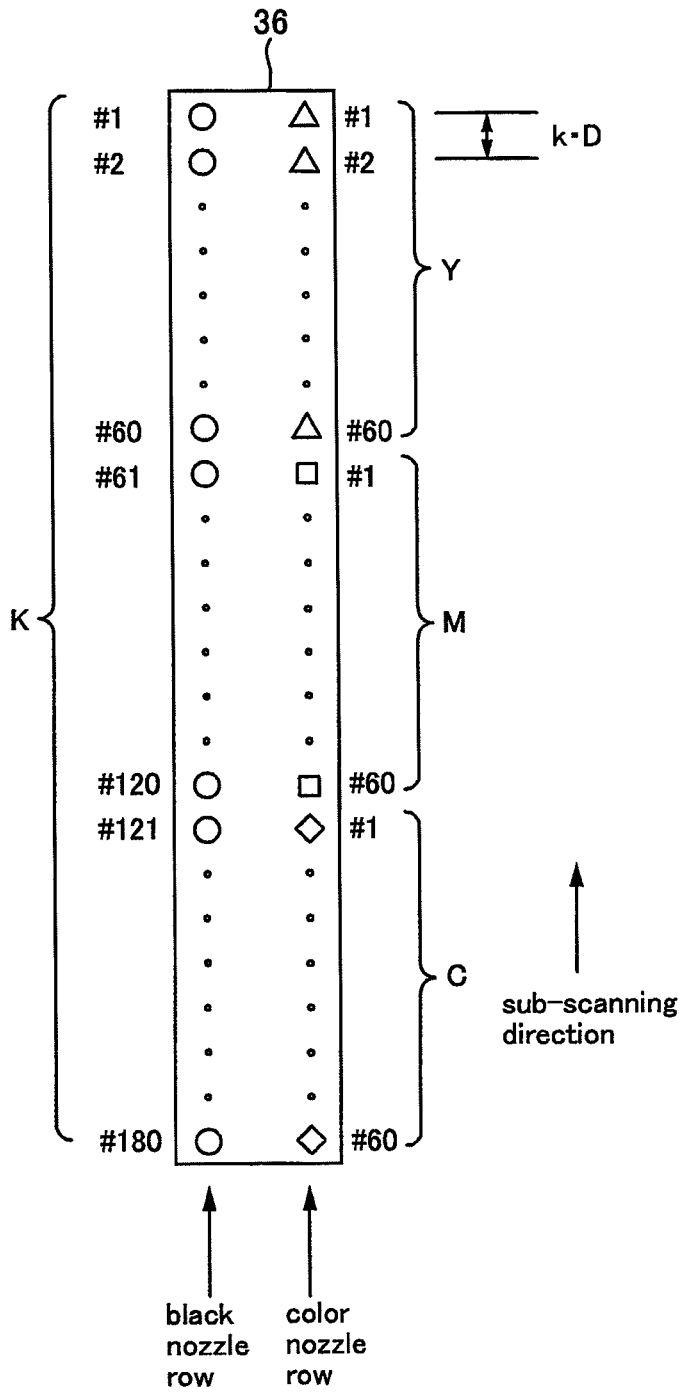
FIG. 8 is a diagram for explaining how the nozzles are arranged in the lower surface of a print head 36.

FIG. 8 is a diagram for explaining the arrangement of the nozzles on the lower surface of the print head 36. A black nozzle row K, and a yellow nozzle row Y, a magenta nozzle row M, and a cyan nozzle row C as a color nozzle row are formed in the lower surface of the print head 36.

The black nozzle row K has 180 nozzles #1 to #180 (shown by white circles). The 180 nozzles #1 to #180 (white circles) are arranged in the sub-scanning direction shown in FIG. 2 in a straight line at a constant interval (nozzle pitch k·D). The yellow nozzle row Y has 60 nozzles #1 to #60 (white triangles), the magenta nozzle row M has 60 nozzles #1 to #60 (white squares), and the cyan nozzle row C has 60 nozzles #1 to #60 (white diamonds). These 180 nozzles of the nozzles #1 to #60 (white triangles, white squares, and white diamonds)

are arranged in the sub-scanning direction shown in FIG. 2 in a straight line at a constant interval (nozzle pitch k·D). Here D refers to the smallest dot pitch in the sub-scanning direction (that is, the spacing at the highest resolution of the dots formed on the print paper P). For example, if the resolution is 1,440 dpi, then the spacing is 1/1,440 inch (approximately 17.65 μm). Also, k is an integer of 1 or more.

For example, each nozzle is provided with a piezo element, which is not shown, as a drive element for driving the nozzle and causing it to eject ink droplets. However, there is no limitation to a piezo element. It is also possible to employ a method in which an electric current is sent through a heat resistant member arranged in the ink compartment to vaporize the ink in the ink compartment by rapidly generating heat, thereby ejecting ink from the nozzle due to pressure from the bubble that forms at that time.

It should be noted that, during printing, the print paper P is carried intermittently in the sub-scanning direction by a predetermined carry amount, and between these intermittent carries, the carriage 28 is moved in the main-scanning direction and ink droplets are ejected from the nozzles.

—Printing Method of the First Embodiment—

Figure 9:
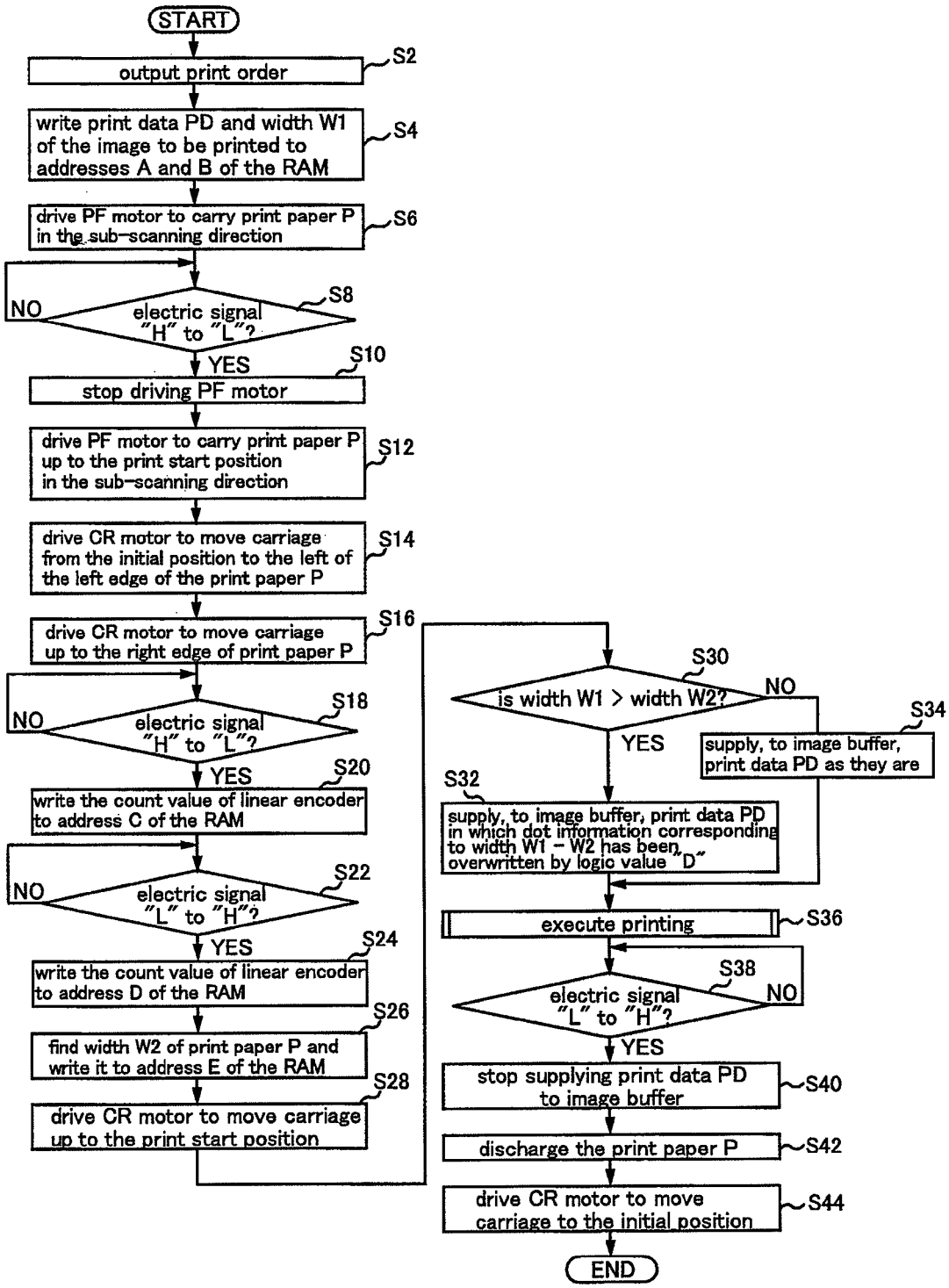
FIG. 9 is a flowchart for describing a printing method of the first embodiment.
Figure 10:
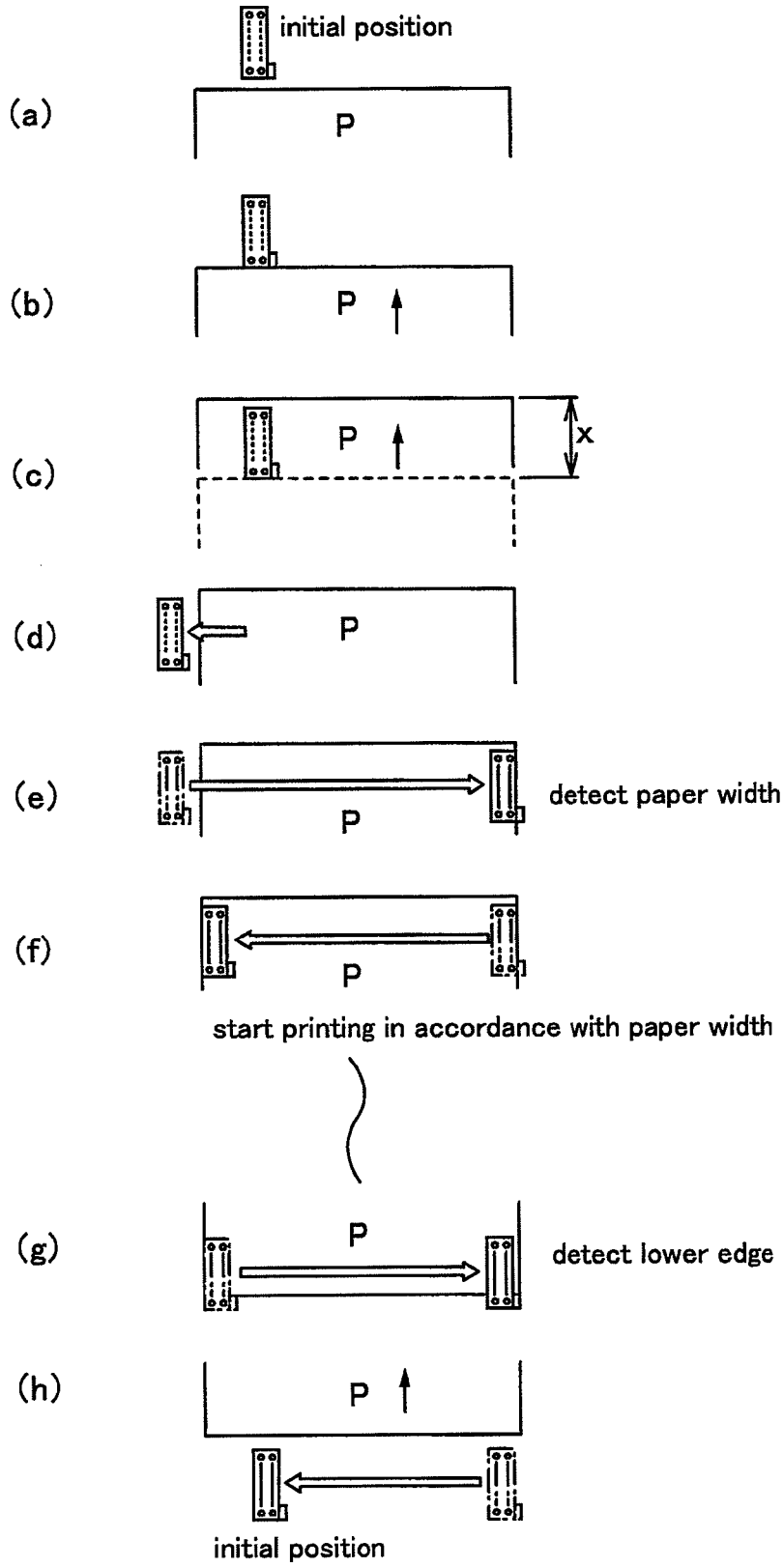
FIGS. 10(*a*) through 10(*h*) are schematic diagrams for describing the positional relationship between the print head 36, the reflective optical sensor 29, and the print paper P when printing is executed using the printing method of the first embodiment.
Figure 11:
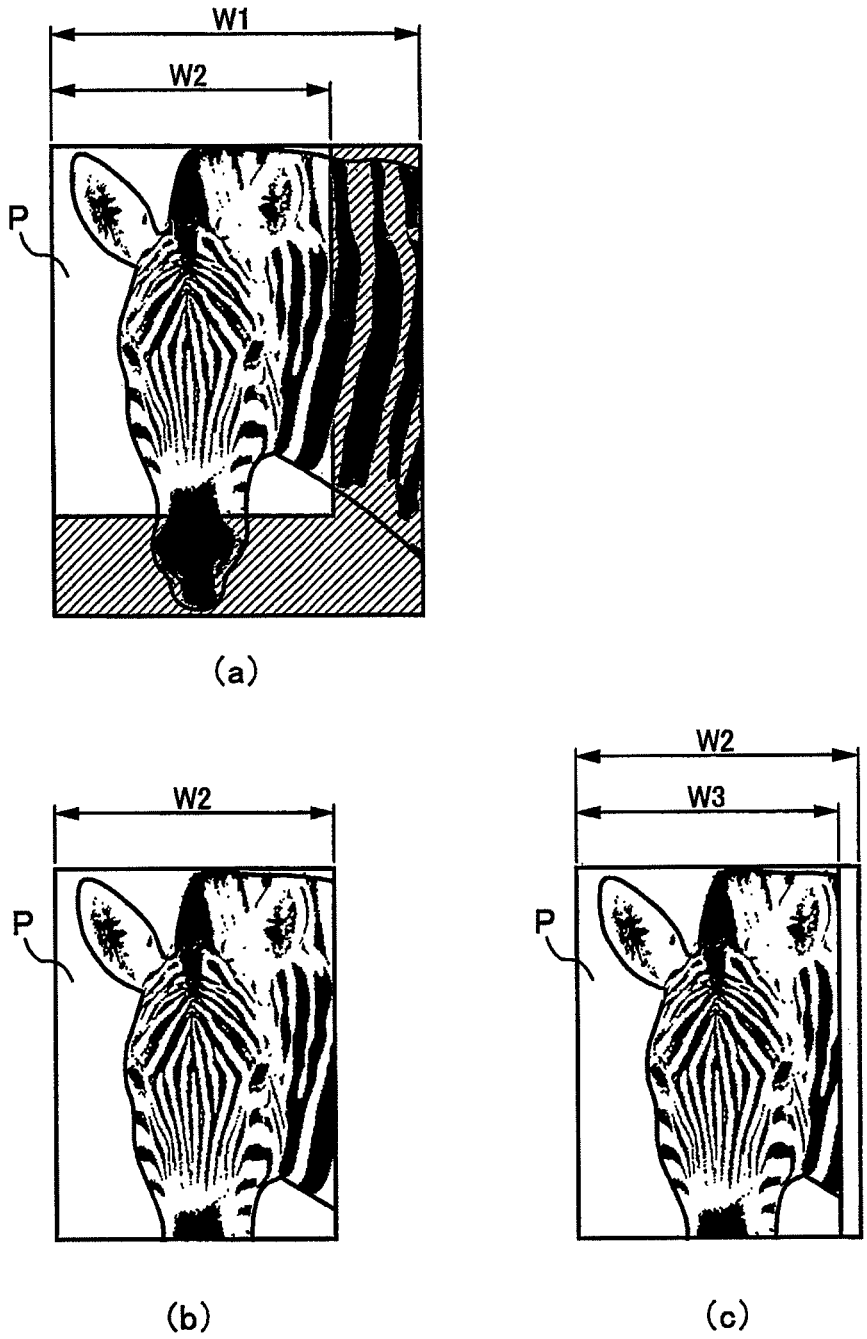
FIGS. 11(*a*) through 11(*c*) are diagrams showing examples of the print image that is obtained by executing the printing method of the first embodiment.

FIG. 9, FIG. 10, and FIG. 11 are referenced in the following description of the printing method of the first embodiment. FIG. 9 is a flowchart for describing the printing method of the first embodiment. FIG. 10 is a schematic diagram for describing the positional relationship between the print head 36, the reflective optical sensor 29, and the print paper P when printing is executed using the printing method of the first embodiment. It should be noted that in FIG. 10 the print head 36 is viewed from above (from the side opposite from the face of FIG. 8), and the white circles on the paper-face upper side of the print head 36 indicate the black nozzle #1 and the yellow nozzle #1, and the white circles on the paper-face lower side of the print head 36 indicate the black nozzle #180 and the cyan nozzle #60. Also, the print paper P is carried in the sub-scanning direction from the side with the black nozzle #180 and the cyan nozzle #60 when printing is executed (see FIG. 8). FIG. 11 is a diagram showing an example of the print image that is obtained by executing the printing method of the first embodiment. In particular, FIG. 11(*a*) indicates the relationship between the width W1 over which the image based on the image data should be printed and the width W2 (<W1) of the print paper P. FIG. 11(*b*) indicates how an image of width W2 is borderlessly printed on the print paper P from the image of the width W1. In other words, the image of W1−W2 is deleted. FIG. 11(*c*) shows how an image with a width W3 (<W2) is printed with a border on the print paper P from the image of the width W1. In other words, the image of W1−W3 (>W1−W2) is deleted and a border W2−W3 is added to the right edge.

First, when the power is turned on, the system controller 54 supplies control signals for initialization to the main-scan drive circuit 61, the sub-scan drive circuit 62, and the head drive circuit 63 in accordance with the results of interpreting the program data for initialization that are read from the main memory 56. Due to this, the carriage 28 receives the drive force that is transmitted from the CR motor 30 and stops at a predetermined initial position in the main-scanning direction. In other words, the print head 36 that is provided on the carriage 28 also stops at the same initial position (see FIG. 10(*a*)).

When the application program 95 receives a command for printing a predetermined image (for example, a magnified image of the face of an animal) from the user, the application program 95 outputs print orders for printing the predetermined image to control the video driver 91 and the printer driver 96. As a result, the printer driver 96 obtains image data for printing the predetermined image from the application program 95, processes these into print data PD and various commands COM, and supplies them to the color inkjet printer 20. The color inkjet printer 20 supplies control signals for printing the predetermined image to the main-scan drive circuit 61, the sub-scan drive circuit 62, the head drive circuit 63, and the reflective optical sensor control circuit 65 in accordance with the print data PD and the various commands COM, and thus the following sequence is executed (S2).

In the system controller 54, the print data PD that are supplied from the buffer memory 50 are written to an address A of the RAM 57. It should be noted that the print data PD include information on the dots in the main-scanning direction (binary data of a logic value "1" and a logic value "0") and information on the resolution in the main-scanning direction (dpi). Accordingly, the system controller 54 executes predetermined computations with respect to the total bit number of the binary data in the main-scanning direction and the resolution in the main-scanning direction to find the width W1 of the predetermined image that is to be printed, and writes this width W1 to an address B of the RAM 57 (S4).

It should be noted that the method for finding the width W1 of the predetermined image to be printed is not limited to this method. For example, it is also possible to add information indicating the width W1 of the predetermined image to the header of the print data PD and have the system controller 54 extract the header information from the print data PD and find the width W1 of the predetermined image.

The sub-scan drive circuit 62 drives the PF motor 31, and as a result the print paper P starts to be carried toward the print head 36 in the sub-scanning direction (upward in the paper face of FIG. 10) (S6).

The system controller 54 determines whether or not the upper edge of the print paper P has been carried to the position of the reflective optical sensor 29. More specifically, the system controller 54 determines whether or not the upper edge of the print paper P has been carried to the position of the reflective optical sensor 29 based on the measurement results that are obtained from the electric signal measuring section 66 of the reflective optical sensor control circuit 65 (S8). Here, the electric signal measuring section 66 of the reflective optical sensor control circuit 65 measures the intensity of the electric signal that is obtained from the light-receiving member 40, and supplies the result of this measurement to the system controller 54. It should be noted that the logic within the electric signal measuring section 66 is designed so that the result of the measurement that is obtained from the electric signal measuring section 66 is at high level ("H") based on the intensity of the electric signal of the light-receiving member 40 when the light-emitting member 38 emits light onto the platen 26, and is at low level ("L") based on the intensity of the electric signal of the light-receiving member 40 when the light-emitting member 38 emits light onto the print paper P.

When the measurement result that is obtained from the electric signal measuring section 66 is the high level, the system controller 54 determines that the upper edge of the print paper P has not been carried to the position of the reflective optical sensor 29 (S8: NO). In other words, step 6 is executed again and the sub-scan drive circuit 62 continues to drive the PF motor 31.

On the other hand, when the measurement result that is obtained from the electric signal measuring section 66 has changed from the high level to the low level, the system controller 54 determines that the upper edge of the print paper P has been carried to the position of the reflective optical sensor 29 (S8: YES/see FIG. 10(*b*)). At this time, the sub-scan drive circuit 62 stops driving the PF motor 31 (S10).

The system controller 54 supplies, to the sub-scan drive circuit 62, a control signal for carrying the print paper P up to the print start position in accordance with the print data PD. The sub-scan drive circuit 62 drives the PF motor 31, and the print paper P is accordingly carried by a distance X from the stop position of FIG. 10(*b*) to the print start position, and is then stopped. It should be noted that the distance X is a distance that is set in accordance with various conditions, such as whether or not the upper edge side of the print paper P has a border, and if the upper edge side of the print paper P has a border, the width mm of the border. For example, in the case of a setting in which the upper edge side of the print paper P is borderless, then the distance X can be a distance 179 kD, which is the distance for the upper edge of the print paper P to come up to the position where the black nozzle #1 and the yellow nozzle #1 of the print head 36 are arranged, or it can be a distance that is less than 179 kD in order to ensure that printing is carried out reliably (S12/see FIG. 10(*c*)).

The system controller 54 supplies, to the main-scan drive circuit 61, a control signal for moving the carriage 28 from the initial position to the left of the left edge of the print paper P. The main-scan drive circuit 61 drives the CR motor 30 according to this control signal. As a result, the carriage 28 starts moving to the left from the initial position, and stops at the position where the reflective optical sensor 29 emits light onto the platen 26 to the left of the print paper P. That is, by the carriage subsequently moving to the right in the main-scanning direction, the reflective optical sensor 29 becomes able to supply, to the reflective optical sensor control circuit 65, an electric signal for detecting the width W2 of the print paper P, or in other words, an electric signal whose level changes at the positions of the left edge and the right edge of the print paper P (S14/see FIG. 10(*d*)).

The system controller 54 supplies, to the main-scan drive circuit 61, a control signal for moving the carriage 28 from the left side of the left edge to the right edge of the print paper P. The main-scan drive circuit 61 drives the CR motor 30 according to this control signal. The carriage 28 thus starts moving to the right from the left side of the left edge of the print paper P. In other words, the operation for the reflective optical sensor 29 to detect the width W2 of the print paper P is started (S16/see FIG. 10(*e*)).

The system controller 54 determines whether or not the reflective optical sensor 29 is at the position of the left edge of the print paper P based on the measurement results obtained from the electric signal measuring section 66 of the reflective optical sensor control circuit 65 (S18).

When the measurement results obtained from the electric signal measuring section 66 have changed from the high level to the low level, the system controller 54 determines that the reflective optical sensor 29 has changed from a state in which it irradiates light onto the platen 26 to a state in which it irradiates light onto the print paper P, and that the reflective optical sensor 29 is at the position of the left edge of the print paper P (S18: YES).

The system controller 54 reads the count value of the linear encoder 11 at the point that the measurement result from the electric signal measuring section 66 changes from the high level to the low level and writes this to an address C of the RAM 57. The position of the left edge of the print paper P is thus determined (S20).

Similarly, the system controller 54 next determines whether or not the reflective optical sensor 29 is at the position of the right edge of the print paper P based on the measurement results obtained from the electric signal measuring section 66 of the reflective optical sensor control circuit 65 (S22).

When the measurement results obtained from the electric signal measuring section 66 have changed from the low level to the high level, the system controller 54 determines that the reflective optical sensor 29 has changed from a state in which it irradiates light onto the print paper P to a state in which it irradiates light onto the platen 26, and that the reflective optical sensor 29 is at the position of the right edge of the print paper P (S22: YES).

The system controller 54 reads the count value of the linear encoder 11 at the point that the measurement result from the electric signal measuring section 66 changes from the low level to the high level, and writes this to an address D of the RAM 57. The position of the right edge of the print paper P is thus determined (S24).

The system controller 54 finds the difference between the count values of the linear encoder 11 that are stored in the addresses C and D of the RAM 57, and by performing a predetermined computation correlating this difference and the slit spacing X, the system controller 54 finds the width W2 of the print paper P and writes this width W2 to an address E of the RAM 57 (S26).

The system controller 54 supplies, to the main-scan drive circuit 61, a control signal for moving the carriage 28 from the right edge of the print paper P to the print start position to the left of the print paper P. The main-scan drive circuit 61 drives the CR motor 30 in accordance with this control signal. As a result, the carriage 28 moves from the right edge of the print paper P to the print start position on the left of the print paper P, and stops (S28/see FIG. 10(*f*)).

The system controller 54 determines whether or not the width W2 of the print paper P is less than the width W1 of the predetermined image to be printed (S30).

The system controller 54 compares the information on the width W1 and the width W2 stored in the addresses B and E of the RAM 57, and when it determines that the width W2 of the print paper P is less than the width W1 of the predetermined image to be printed (S30: YES), it reads the print data PD from the address A of the RAM 57, rewrites the information, in the print data PD, of the dots at positions corresponding to the width difference W1−W2 to the logic value "0," and supplies the print data PD to the image buffer 52. It should be noted that until printing of the predetermined image is finished, the print data PD that are consecutively stored in the address A of the RAM 57 are processed in the manner described above (S32).

On the other hand, when the system controller 54 compares the information on the width W1 and the width W2 stored in the addresses B and E of the RAM 57 and determines that the width W2 of the print paper P is equal to or greater than the width W1 of the predetermined image to be printed (S30: NO), it reads the print data PD from the address A of the RAM 57 and supplies them to the image buffer 52 unchanged. It should be noted that until printing of the predetermined image is finished, the print data PD that are consecutively stored in the address A of the RAM 57 are processed in the manner described above (S34).

The system controller 54 then supplies control signals for executing printing to the main-scan drive circuit 61, the sub-scan drive circuit 62, and the head drive circuit 63. As a result, the drive force of the CR motor 30 is transmitted to the carriage 28, thereby moving the carriage 28 back and forth in the main-scanning direction; the drive force of the PF motor 31 is transmitted to the print paper P, thereby carrying the print paper P in the sub-scanning direction in units of predetermined carry amounts; the print head 36 suitably ejects ink in accordance with the various information of the print data PD; these operations are carried out at an appropriate timing. In other words, the predetermined image is printed on the print paper P. It should be noted that the carriage 28 moves back and forth in the main-scanning direction over the width W1 of the predetermined image to be printed in accordance with the information of the print data PD. However, even if the width W2 of the print paper P is less than the width W1 of the predetermined image to be printed, the image within the width difference W1−W2 will not be printed due to all the dot information thereof being changed to the logic value "0," and thus the platen 26 does not become dirty (S36).

The system controller 54 next determines whether or not the lower edge of the print paper P has been carried to the position of the reflective optical sensor 29 based on the measurement results obtained from the electric signal measuring section 66 of the reflective optical sensor control circuit 65 (S38).

The system controller 54 determines that the lower edge of the print paper P has been carried to the position of the reflective optical sensor 29 when, for the entire period during which the carriage 28 moves back and forth in the main-scanning direction, the measurement result obtained from the electric signal measuring section 66 has changed from the low level to the high level (S38: YES/see FIG. 10(*g*)). At this time, the system controller 54 stops supplying the print data PD to the image buffer 52. As a result, the print head 36 no longer ejects ink (S40). The sub-scan drive circuit 62 then further drives the PF motor 31 and discharges the print paper P (S42).

Lastly, the system controller 54 supplies, to the main-scan drive circuit 61, a control signal for returning the carriage 28 back to the initial position. The main-scan drive circuit 61 drives the CR motor 30 according to this control signal. As a result, the carriage 28 is moved to the initial position and stops, thereby being ready for the next print operation (S44/see FIG. 10(*h*)).

It should be noted that the reflective optical sensor 29 can be constituted by individual units for detecting the upper edge, the lower edge, the left edge, and the right edge of the print paper P.

<Printing the Image on the Print Paper P>

It is not possible to print the image of the hatched area onto the print paper P when the width W2 of the print paper P is shorter than the width W1 of a predetermined image to be printed (see FIG. 11(*a*)). When the printing method of the present embodiment is adopted, however, only the portion of the width W2, of the width W1 of the predetermined image to be printed, is printed on the print paper P without causing the platen 26 to become dirty (see FIG. 11(*b*)). As a result, the user can look at a print image in which a portion of a person's face is missing and notice that there is a difference in size between the print paper that is currently loaded and the print paper that should have been loaded, and by quickly changing the print paper he/she can effectively cope with the problem. Also, by adding a border W2−W3 to the print paper P, the platen 26 can be effectively prevented from becoming dirty (see FIG. 11(*c*)).

It should be noted that with the printing method of the present embodiment, printing is carried out to match the width W2 of the print paper P, and therefore, as long as the width W2 of the print paper P is only slightly shorter than the width W1 of a predetermined image to be printed, it is possible to use the image to be printed on the print paper P as is.

Incidentally, when printing a predetermined image to the print paper P, if the width of the print paper P is shorter than the width, in a direction intersecting the carrying direction of the print paper P, over which the predetermined image should be printed, then there is a possibility that the ink corresponding to a portion, of among the information of the predetermined image, that exceeds the width of the print paper P will be ejected onto the color ink printer 20 itself and both dirty the color inkjet printer 20 and waste the print paper P.

Accordingly, when the width of the print paper P is shorter than the width over which the predetermined image should be printed, then a portion of the image, of among the predetermined image, that corresponds to the width, or to less than the width, of the print paper P is printed on the print paper P by the print head 36. Thus, it is possible to prevent the color inkjet printer 20 from becoming dirty and the print paper P from being wasted.

Further, if the width of the print paper P that has been detected by the reflective optical sensor 29 is shorter than the width, in a direction that intersects the carrying direction of the print paper P, over which the predetermined image should be recorded, then a portion of the image, of among the predetermined image, that corresponds to the width of the print paper P that has been detected by the reflective optical sensor 29 may be printed on the print paper P by the print head 36.

By doing this, the predetermined image is printed over the entire width of the print paper P, and thus it is possible to prevent the color inkjet printer 20 from becoming dirty due to the ejection of ink, and, through the simple method of determining from the content printed on the print paper P that the size of the print paper P is different, prevent the print paper P from being wasted.

Further, if the width of the print paper P that has been detected by the reflective optical sensor 29 is shorter than the width, in a direction that intersects the carrying direction of the print paper P, over which the predetermined image should be printed, then a portion of the image, of among the predetermined image, that corresponds to the width obtained by subtracting the border width from a width of the print paper P that has been detected by the reflective optical sensor 29, may be printed on the print paper P by the print head 36.

As a result, a border is added to the predetermined image when printing to the print paper P, and thus it is possible to effectively prevent the color inkjet printer 20 from becoming dirty due to the ejection of ink, and, through the simple method of determining from the content printed on the print paper P that the size of the print paper P is different, prevent the print paper P from being wasted.

It is also possible for the reflective optical sensor 29 to move in a direction that intersects the carrying direction of the print paper P to detect whether or not the print paper P is present, and based on whether or not the print paper P is present, to detect the width of the print paper P.

Thus, the color inkjet printer 20 can be prevented from becoming dirty and the print paper P can be prevented from being wasted by using a reflective optical sensor 29 that detects the width of the print paper P based on whether or not the print paper P is present in a direction that intersects the carrying direction of the print paper P.

It is further possible to provide the reflective optical sensor 29 and the print head 36 together in/on the carriage 28, which is for moving in a direction that intersects the carrying direction of the print paper P.

By using a reflective optical sensor 29 that is provided in/on the carriage 28, which is for moving in a direction that intersects the carrying direction of the print paper P, together with the print head 36, it is possible to prevent the color inkjet printer 20 from becoming dirty and the print paper P from being wasted.

It is also possible for the reflective optical sensor 29 to have the light-emitting member 38 for emitting light and the light-receiving member 40 for receiving the light emitted from the light-emitting member 38, and to detect whether or not the print paper P is present based on the output value of the light-receiving member 40.

In this way, by using a reflective optical sensor 29 that has the light-emitting member 38 for emitting light and the light-receiving member 40 for receiving light emitted from the light-emitting member 38, it is possible to prevent the color inkjet printer 20 from becoming dirty and to prevent the print paper P from being wasted.

—Others (First Embodiment)—

A recording apparatus, a recording method, a program, and a computer system according to the present invention were described above through a first embodiment. However, the foregoing embodiment of the invention is for the purpose of elucidating the present invention and is not to be interpreted as limiting the present invention. The invention can of course be altered and improved without departing from the gist thereof, and includes equivalents.

<Moving Member>

In the color inkjet printer 20, it is also possible for the carriage 28 to move back and forth in the main-scanning direction by only the width W2 of the print paper P that has been detected by the reflective optical sensor 29, and to disregard the dot information corresponding to the width W1−W2. As a result, it is not necessary to change the dot information making up the print data PD, and thus the control for printing a predetermined image on the print paper P can be simplified.

<Detection Means>

The light-emitting member 38 and the light-receiving member 40 that make up the reflective optical sensor 29 serving as the detection means are provided together with the print head 36 on the carriage 28, but there is no limitation to this configuration. For example, it is possible to adopt a light-emitting member 38 and a light-receiving member 40 that are moved in the main-scanning direction in synchronization with the carriage 28 but that are separate from the carriage 28. Also, the detection means is not limited to the reflective optical sensor 29. For example, a transmissive optical sensor wherein the print paper P is interposed on the path over which light is emitted and received, a line sensor, or an area sensor, for example, can also be employed.

<Recording Medium>

The recording medium is not limited to the print paper P. Cloth, thin metal plates, and film, for example, can also be used as the recording medium.

<Recording Apparatus>

The recording apparatus, as a printer, is not limited to the color inkjet printer 20. For example, the recording apparatus can also be adopted for monochrome inkjet printers or printers that do not employ the inkjet method, for example. In such a case, the printer can have some of the functions or the mechanisms of the main computer unit, the display device, the input device, the flexible disk drive device, and the CD-ROM drive device. For example, the printer can have an image processing section for carrying out image processing, a display section for carrying out various types of displays, and a recording media attachment/detachment section to and from which a recording medium, on which image data captured by a digital camera or the like are recorded, can be attached and detached.

Furthermore, the recording apparatus is not limited to a printer. For example, it is also possible to adopt the recording apparatus to a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. When the present invention is employed in these fields, it is possible to achieve a reduction in material, process steps, and costs compared to conventional cases because one of its characteristics is that liquid can be directly ejected (directly written) onto a target object.

<Liquid>

The liquid is not limited to ink (such as dye inks and pigment inks). For example, it is also possible to employ liquid (including water) including metallic material, organic material (particularly macromolecular material), magnetic material, conductive material, wiring material, film-formation material, electronic ink, machining liquid, and genetic solutions.

With the first embodiment, it is possible to prevent the recording apparatus from becoming dirty and the recording medium from being wasted.

—Printing Method of the Second Embodiment—

Figure 12:
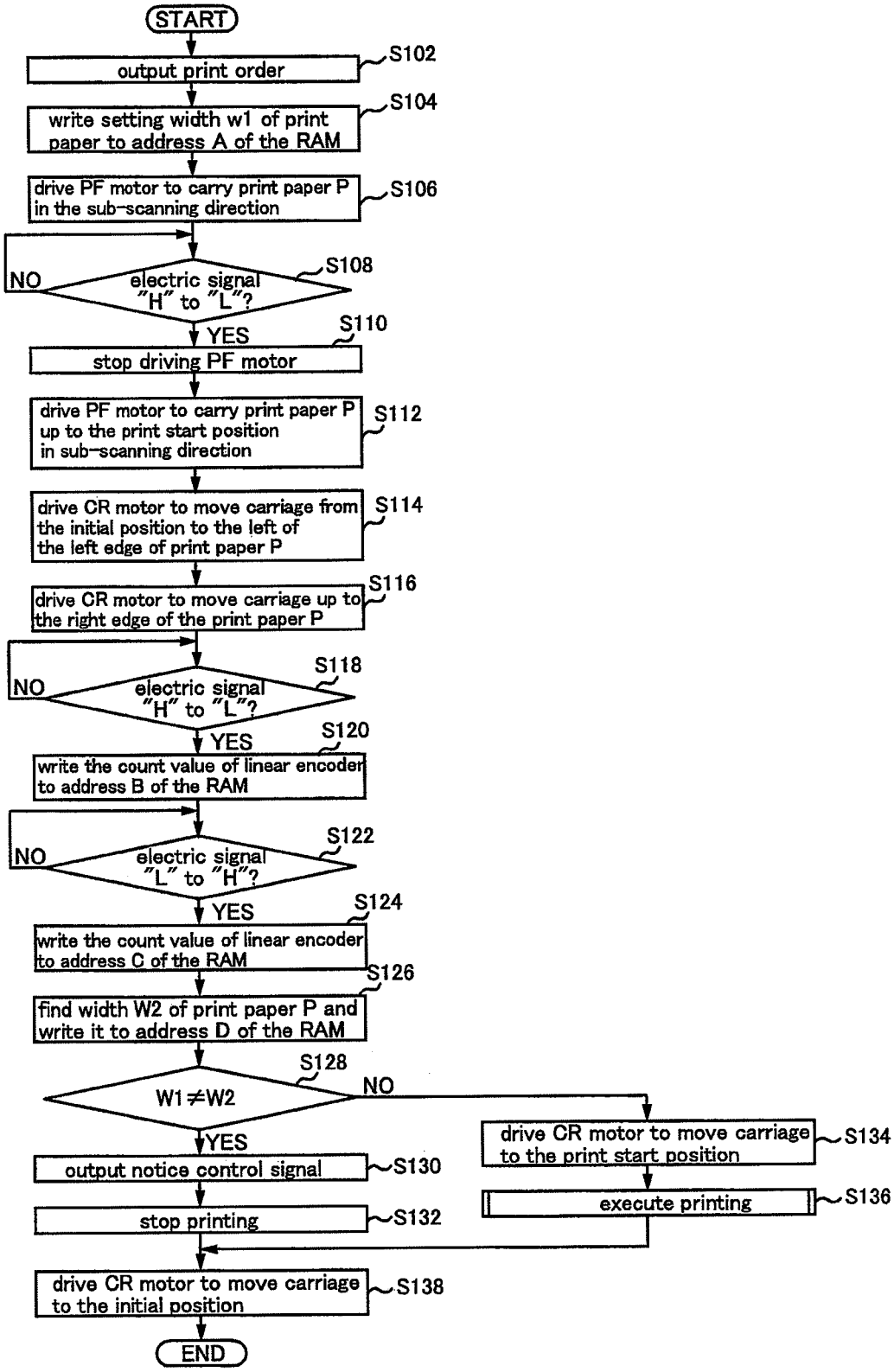
FIG. 12 is a flowchart for describing the printing method of the second embodiment.
Figure 13:
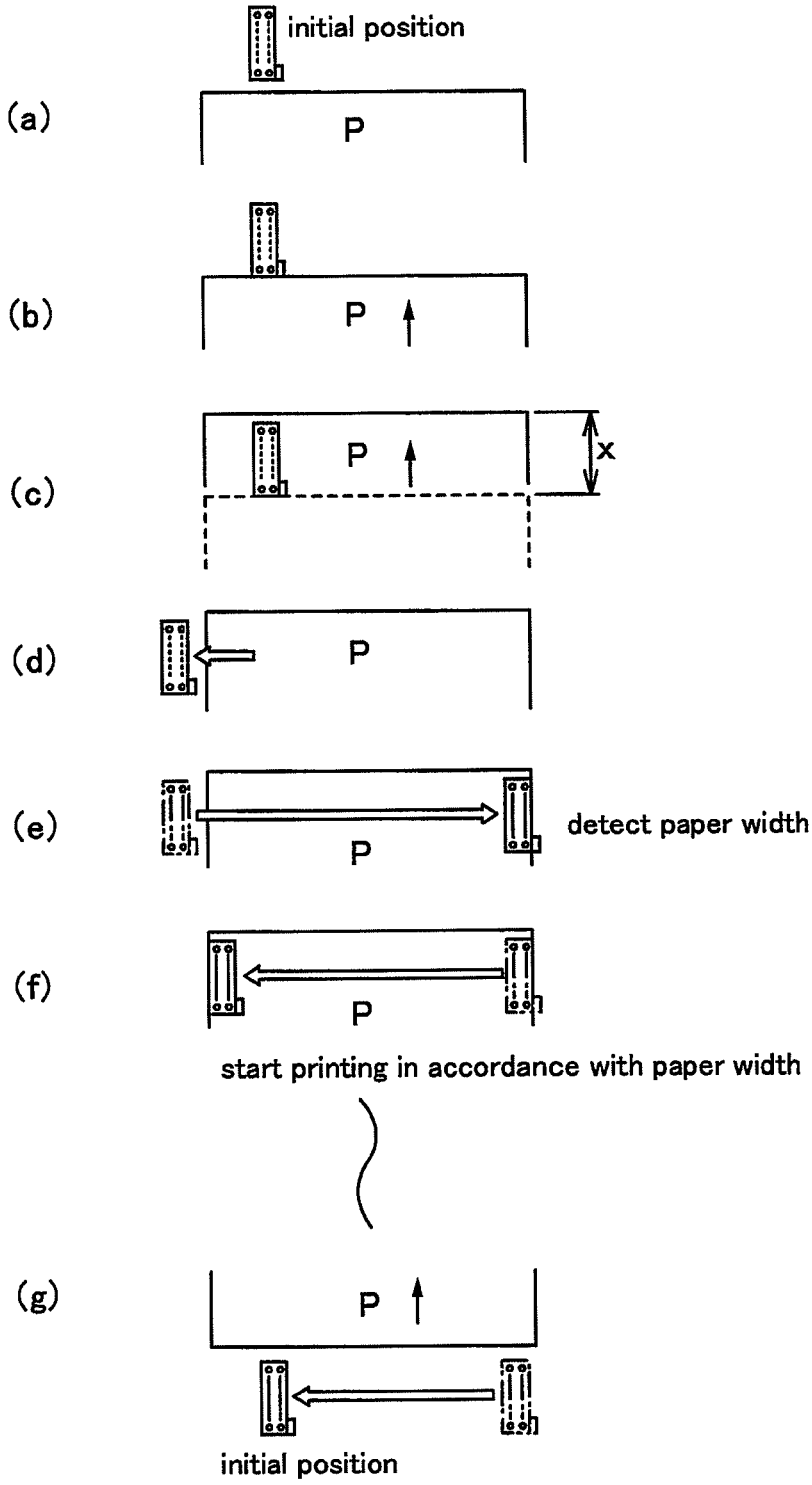
FIGS. 13(*a*) through 13(*g*) are schematic diagrams for describing the positional relationship between the print head 36, the reflective optical sensor 29, and the print paper P when printing is executed using the printing method of the second embodiment.

The printing method of the second embodiment is described below with reference to FIG. 12 and FIG. 13. FIG. 12 is a flowchart for describing the printing method of the second embodiment. FIG. 13 is a schematic diagram for describing the positional relationship between the print head 36, the reflective optical sensor 29, and the print paper P when carrying out printing using the printing method of the second embodiment. It should be noted that in FIG. 13 the print head 36 is viewed from above (from the side opposite from the face of FIG. 8), and the white circles on the paper-face upper side of the print head 36 indicate the black nozzle #1 and the yellow nozzle #1, and the white circles on the paper-face lower side of the print head 36 indicate the black nozzle #180 and the cyan nozzle #60. Also, the print paper P is carried in the sub-scanning direction from the side with the black nozzle #180 and the cyan nozzle #60 when executing printing (see FIG. 8).

First, when the power is turned on, the system controller 54 supplies control signals for initialization to the main-scan drive circuit 61, the sub-scan drive circuit 62, the head drive circuit 63, the reflective optical sensor control circuit 65, and the notice control circuit 67 in accordance with the results of interpreting the program data for initialization that are read from the main memory 56. Due to this, the carriage 28 receives the drive force of the CR motor 30 that is transmitted thereto and stops at a predetermined initial position in the main-scanning direction. In other words, the print head 36 that is provided in the carriage 28 also stops at the same initial position (see FIG. 13(*a*)).

When the application program 95 receives a command for printing a predetermined image from the user, the application program 95 outputs a print order for printing the predetermined image to control the video driver 91 and the printer driver 96. As a result, the printer driver 96 obtains image data for printing the predetermined image from the application program 95, processes these into print data PD and various commands COM, and supplies them to the color inkjet printer 20. The color inkjet printer 20 supplies control signals for printing the predetermined image to the main-scan drive circuit 61, the sub-scan drive circuit 62, the head drive circuit 63, and the reflective optical sensor control circuit 65 in accordance with the print data PD and the various commands COM, and thus the following sequence is executed (S102).

The system controller 54 interprets the various commands COM and writes the width W1 of the size of the print paper P that is set in the user interface display module 101, which serves as the setting means (setting section), to the address A of the RAM 57 (S104).

The sub-scan drive circuit 62 drives the PF motor 31, and as a result, the print paper P starts being carried toward the print head 36 in the sub-scanning direction (upward in the paper face of FIG. 13) (S106).

The system controller 54 determines whether or not the upper edge of the print paper P has been carried to the position of the reflective optical sensor 29. More specifically, the system controller 54 determines whether or not the upper edge of the print paper P has been carried to the position of the reflective optical sensor 29 based on the measurement results that are obtained from the electric signal measuring section 66 of the reflective optical sensor control circuit 65 (S108). Here, the electric signal measuring section 66 of the reflective optical sensor control circuit 65 measures the intensity of the electric signal that is obtained from the light-receiving member 40, and supplies the result of this measurement to the system controller 54. It should be noted that the logic within the electric signal measuring section 66 is designed so that the result of the measurement that is obtained from the electric signal measuring section 66 is at high level ("H") based on the intensity of the electric signal of the light-receiving member 40 when the light-emitting member 38 emits light onto the platen 26, and is at low level ("L") based on the intensity of the electric signal of the light-receiving member 40 when the light-emitting member 38 emits light onto the print paper P.

When the measurement result that is obtained from the electric signal measuring section 66 is at the high level, the system controller 54 determines that the upper edge of the print paper P has not been carried to the position of the reflective optical sensor 29 (S108: NO). In other words, step 106 is executed again and the sub-scan drive circuit 62 continues to drive the PF motor 31.

On the other hand, when the measurement result that is obtained from the electric signal measuring section 66 has changed from the high level to the low level, the system controller 54 determines that the upper edge of the print paper P has been carried to the position of the reflective optical sensor 29 (S108: YES/see FIG. 13(*b*)). At this time, the sub-scan drive circuit 62 stops driving the PF motor 31 (S110).

The system controller 54 supplies, to the sub-scan drive circuit 62, a control signal for carrying the print paper P up to the print start position in accordance with the result that is obtained by interpreting the command COM. The sub-scan drive circuit 62 drives the PF motor 31, and the print paper P is accordingly carried by a distance X from the stop position of FIG. 13(*b*) to the print start position, and is then stopped. It should be noted that the distance X is a distance that is set in accordance with various conditions, such as whether or not the upper edge side of the print paper P has a border, and if the upper edge side of the print paper P has a border, the width mm of the border. For example, in the case of a setting in which the upper edge side of the print paper P is borderless, then the distance X can be the distance 179 kD, which is the distance for the upper edge of the print paper P to come up to the position where the black nozzle #1 and the yellow nozzle #1 of the print head 36 are arranged, or it can be a distance that is less than 179 kD in order to ensure that printing is carried out reliably (S112/see FIG. 13(*c*)).

The system controller 54 supplies, to the main-scan drive circuit 61, a control signal for moving the carriage 28 from the initial position to the left of the left edge of the print paper P. The main-scan drive circuit 61 drives the CR motor 30 according to this control signal. Thus, the carriage 28 starts moving to the left from the initial position, and stops at the position where the reflective optical sensor 29 emits light onto the platen 26 to the left of the print paper P. That is, by the carriage 28 subsequently moving to the right in the main-scanning direction, the reflective optical sensor 29 becomes able to supply, to the reflective optical sensor control circuit 65, an electric signal for detecting the width W2 of the print paper P, or in other words, an electric signal whose level changes at the positions of the left edge and the right edge of the print paper P (S114/see FIG. 13(*d*)).

The system controller 54 supplies, to the main-scan drive circuit 61, a control signal for moving the carriage 28 from the left side of the left edge to the right edge of the print paper P. The main-scan drive circuit 61 drives the CR motor 30 according to this control signal. The carriage 28 thus starts moving to the right from the left side of the left edge of the print paper P. In other words, the operation through which the reflective optical sensor 29 detects the width W2 of the print paper P is started (S116/see FIG. 13(*e*)).

The system controller 54 determines whether or not the reflective optical sensor 29 is at the position of the left edge of the print paper P based on the measurement results obtained from the electric signal measuring section 66 of the reflective optical sensor control circuit 65 (S118).

When the measurement results obtained from the electric signal measuring section 66 have changed from the high level to the low level, the system controller 54 determines that the reflective optical sensor 29 has changed from a state in which it irradiates light onto the platen 26 to a state in which it irradiates light onto the print paper P, and that the reflective optical sensor 29 is at the position of the left edge of the print paper P (S118: YES).

The system controller 54 reads the count value of the linear encoder 11 at the point that the measurement result from the electric signal measuring section 66 changes from the high level to the low level and writes this to an address B of the RAM 57. The position of the left edge of the print paper P is thus determined (S120).

Similarly, the system controller 54 next determines whether or not the reflective optical sensor 29 is at the position of the right edge of the print paper P based on the measurement results obtained from the electric signal measuring section 66 of the reflective optical sensor control circuit 65 (S122).

When the measurement results obtained from the electric signal measuring section 66 have changed from the low level to the high level, the system controller 54 determines that the reflective optical sensor 29 has changed from a state in which it irradiates light onto the print paper P to a state in which it irradiates light onto the platen 26, and that the reflective optical sensor 29 is at the position of the right edge of the print paper P (S122: YES).

The system controller 54 reads the count value of the linear encoder 11 at the point that the measurement result from the electric signal measuring section 66 changes from the low level to the high level and writes this to an address C of the RAM 57. The position of the right edge of the print paper P is thus determined (S124).

The system controller 54 finds the difference between the count values of the linear encoder 11 that are stored in the addresses B and C of the RAM 57, and by performing a predetermined computation correlating this difference and the slit spacing X, the system controller 54 finds the width W2 of the print paper P and writes this width W2 to an address D of the RAM 57 (S126).

The system controller 54 determines whether or not the setting width W1 of the print paper that is stored in the address A of the RAM 57 is equal to the width W2 of the print paper P that is stored in the address D of the RAM 57 (S128). It should be noted that an error ±α is added to the setting width W1 of the print paper that is set through the user interface display module 101 when it is written to the address A of the RAM 57. The absolute value of the error ±α is set to a value that is larger than the maximum value (experience value) of the dimensional error that may be present in the print paper P. Thus, the system controller 54 can determine that sheets of the print paper P are of an identical standard size even when the sheets of print paper P have error.

If the system controller 54 determines that the setting width W1 of the print paper that is stored in the address A of the RAM 57 is different from the width W2 of the print paper P that is stored in the address D of the RAM 57 (S128: YES), then it supplies a signal for instructing to make a notice to the notice control circuit 67. The notice control circuit 67 supplies a display-notice control signal to the display panel 68, and supplies an audio-notice control signal to the speakers 69. Thus, the display panel 69 displays a message such as "Print paper size is incorrect." and the speakers 69 emit a beep tone, for example, making it possible to urge the user to change the print paper P (S130).

The system controller 54 then supplies control signals for stopping printing to the main-scan drive circuit 61, the sub-scan drive circuit 62, and the head drive circuit 63. The main-scan drive circuit 61 stops driving the CR motor 30, and as a result, the carriage 28 stops. Also, the sub-scan drive circuit 62 drives the PF motor 31, and as a result the print paper P is carried in the sub-scanning direction and ultimately discharged. Further, the head drive circuit 63 stops driving the print head 36, and as a result, the print head 36 enters a state in which it does not eject ink. In other words, printing with respect to the print paper P is stopped (S132).

On the other hand, if the system controller 54 determines that the setting width W1 of the print paper that is stored in the address A of the RAM 57 is the same as the width W2 of the print paper P that is stored in the address D of the RAM 57 (S128: NO), then it supplies, to the main-scan drive circuit 61, a control signal for moving the carriage 28 from the right edge of the print paper P to the print start position to the left of the print paper P. The main-scan drive circuit 61 drives the CR motor 30 according to this control signal. As a result, the carriage 28 moves from the right edge of the print paper P to the print start position on the left side of the print paper P and stops (S134/see FIG. 13(*f*)).

The system controller 54 then supplies control signals for executing printing to the main-scan drive circuit 61, the sub-scan drive circuit 62, and the head drive circuit 63. The main-scan drive circuit 61 drives the CR motor 30, and thus the carriage 28 moves back and forth in the main-scanning direction. Also, the sub-scan drive circuit 62 drives the PF motor 31, and as a result the print paper P is carried in the sub-scanning direction in units of predetermined carry amounts. Further, the head drive circuit 63 drives the print head 36, causing the print head 36 to suitably eject ink based on the various types of information of the print data PD. In other words, these operations are carried out at a suitable timing, and the predetermined image is printed on the print paper P (S136).

Lastly, the system controller 54 supplies, to the main-scan drive circuit 61, a control signal for returning the carriage 28 back to the initial position. The main-scan drive circuit 61 drives the CR motor 30 according to this control signal. As a result, the carriage 28 moves to the initial position and stops, thereby being ready for the next print operation (S138/see FIG. 13(*g*)).

It should be noted that the reflective optical sensor 29 can be constituted by individual units for detecting the upper edge, the left edge, and the right edge of the print paper P.

Incidentally, if the width of the print paper P that has been loaded in the color inkjet printer 20 is shorter than a width of the print paper size that has been set through the user interface display module 101, then there is a possibility that the ink corresponding to the predetermined image of the section exceeding the width of the print paper P will be ejected onto the color ink printer 20 itself and both dirty the color inkjet printer 20 and waste the print paper P. On the other hand, if the width of the print paper P that is provided in the color inkjet printer 20 is longer than a width of the print paper size that has been set through the user interface display module 101, then there is a possibility that nonuniform margins that differ among the other edges of the print paper P will be formed on the print paper P, and for example, when printing a borderless predetermined image on the print paper P, the print paper P will be wasted.

Accordingly, if the width of the print paper P that has been detected by the reflective optical sensor 29 is different from a width of the print paper size that has been set through the user interface display module 101, then a notice is made to notify the user, and thus it is possible to prevent the color inkjet printer 20 from becoming dirty and the print paper P from being wasted.

It is also possible to make a notice using audio information.

Thus, because a notice is made using audio information, it is possible to effectively keep the color inkjet printer 20 from becoming dirty and the print paper P from being wasted.

It is also possible to make a notice using display information.

Thus, because a notice is made using display information, it is possible to effectively keep the color inkjet printer 20 from becoming dirty and the print paper P from being wasted.

It is also possible to stop printing the predetermined image to the print paper P when the width of the print paper P that has been detected by the reflective optical sensor 29 is different from a width of the print paper size that has been set through the user interface display module 101.

Thus, because printing of the predetermined image to the print paper P is stopped, it is possible to effectively keep the color inkjet printer 20 from becoming dirty and the print paper P from being wasted.

It is also possible for a width of the size of the print paper that has been set through the user interface display module 101 to include a predetermined error, and to make a notice when the width of the print paper P that has been detected by the reflective optical sensor 29 differs, by an amount of the error or more, from the width of the size of the print paper that has been set through the user interface display module 101.

Thus, because the width of the print paper that is set includes error, even if variation occurs in the sheets of print paper P that have been loaded in the color inkjet printer 20 due to manufacturing processes, for example, these sheets of print paper P are determined to be the same size, and thus it is possible to effectively prevent the color inkjet printer 20 from becoming dirty and the print paper P from being wasted.

It is also possible for the reflective optical sensor 29 to move in a direction that intersects the carrying direction of the print paper P and, based on whether or not the print paper P is present, to detect the width of the print paper P.

Thus, it is possible to prevent the color inkjet printer 20 from becoming dirty and the print paper P from being wasted by using a reflective optical sensor 29 that detects the width of the print paper P based on whether or not the print paper P is present in a direction that intersects the carrying direction of the print paper P.

It is further possible to provide the reflective optical sensor 29 and the print head 36 together in/on the carriage 28, which is for moving in a direction that intersects the carrying direction of the print paper P.

By using a reflective optical sensor 29 that is provided on the carriage 28, which is for moving in a direction that intersects the carrying direction of the print paper P, together with the print head 36, it is possible to prevent the color inkjet printer 20 from becoming dirty and the print paper P from being wasted.

It is also possible for the reflective optical sensor 29 to have the light-emitting member 38 for emitting light and the light-receiving member 40 for receiving light emitted from the light-emitting member 30, and to detect whether or not the print paper P is present based on the output value of the light-receiving member 40.

Thus, by using a reflective optical sensor 29 that has the light-emitting member 38 for emitting light and the light-receiving member 40 for receiving light emitted from the light-emitting member 38, it is possible to prevent the color inkjet printer 20 from becoming dirty and the print paper P from being wasted.

—Others (Second Embodiment)—

A recording apparatus, a recording method, a program, and a computer system according to a second embodiment were described above through an embodiment thereof. However, the foregoing embodiment of the invention is for the purpose of elucidating the present invention and is not to be interpreted as limiting the present invention. The invention can of course be altered and improved without departing from the gist thereof, and includes equivalents.

<Notice>

In the foregoing embodiment, a case in which a notice is made using the display panel 68 and the speakers 69 provided in the color inkjet printer 20 is described, but this is not a limitation. For example, it is possible for the application program 95 to decode the notice command COM, which is supplied from the color inkjet printer 20, and drive the video driver 91 to display on the CRT 21 a display message (for example, a written message such as "Paper size is incorrect." or an illustration) for indicating that the size of the print paper P that has been loaded in the color inkjet printer 20 is different from the size of the print paper that has been set. At this time, it is also possible to simultaneously emit a sound from the speakers 69. In this way, the CRT 21, which is larger than the display panel 68, can be used to effectively make a notice.

<Detection Means>

The light-emitting member 38 and the light-receiving member 40 that make up the reflective optical sensor 29 serving as the detection means are provided together with the print head 36 on the carriage 28, but there is no limitation to this configuration. For example, it is possible to adopt a light-emitting member 38 and a light-receiving member 40 that are moved in the main-scanning direction in synchronization with the carriage 28 but that are separate from the carriage 28. Also, the detection means is not limited to the reflective optical sensor 29. For example, a transmissive optical sensor wherein the print paper P is interposed on the path over which light is emitted and received, a line sensor, or an area sensor, for example, can also be employed.

<Recording Medium>

The recording medium is not limited to the print paper P. Cloth, thin metal plates, and film, for example, can also be used as the recording medium.

<Recording Apparatus>

The recording apparatus, as a printer, is not limited to the color inkjet printer 20. For example, the recording apparatus can also be adopted for monochrome inkjet printers or printers that do not employ the inkjet method, for example. In such a case, the printer can have some of the functions or the mechanisms of the main computer unit, the display device, the input device, the flexible disk drive device, and the CD-ROM drive device. For example, the printer can have an image processing section for carrying out image processing, a display section for carrying out various types of displays, and a recording media attachment/detachment section to and from which a recording medium, on which image data captured by a digital camera or the like are recorded, can be attached and detached.

Furthermore, the recording apparatus is not limited to a printer. For example, it is also possible to adopt the recording apparatus to a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. When the present invention is employed in these fields, it is possible to achieve a reduction in material, process steps, and costs compared to conventional cases because one of its characteristics is that liquid can be directly ejected (directly written) onto a target object.

<Liquid>

The liquid is not limited to ink (such as dye inks and pigment inks). For example, it is also possible to employ liquid (including water) including metallic material, organic material (particularly macromolecular material), magnetic material, conductive material, wiring material, film-formation material, electronic ink, machining liquid, and genetic solutions.

With the second embodiment, it is possible to prevent the recording apparatus from becoming dirty and the recording medium from being wasted.

—Printing Method of the Third Embodiment—

A third embodiment is described next. With the third embodiment, the ON/OFF of the operation for the detection means to detect the width of the recording medium becomes settable.

—Example of the ON/OFF Setting Screen for the Detection Operation of the Print Paper P Width—

A case in which the operation for the reflective optical sensor 29 to detect the width of the print paper P is set to ON or OFF is described next with reference to FIG. 14 and FIG. 15.

FIG. 14 is an example of the display screen when setting the operation for the reflective optical sensor 29 to detect the width of the print paper P to ON or OFF. FIG. 14 illustrates the relationship between the print mode type (text characters, graph, photograph, etc.), print resolution type (360×360 dpi, 720×720 dpi, 1440×720 dpi, etc.) and the ON/OFF setting check boxes (ON and OFF) in terms of print paper P type (normal paper, matte paper, photograph paper, OHP paper, etc.).

Specifically, for normal paper, a print mode "Text Characters," which has a print resolution of "360×360 dpi", and print modes "Graph" and "Photograph," which have a print resolution of "720×720 dpi", are provided. The ON/OFF setting check box corresponding to the print mode "Text Characters" is initially set to OFF, and the ON/OFF setting check boxes corresponding to the print modes "Graph" and "Photograph"

are initially set to ON. That is, in a state where the ON/OFF setting check boxes are in the initial setting, when the print mode "Text Characters" is executed, the operation for the reflective optical sensor 29 to detect the width of normal paper is stopped, whereas when the print mode "Graph" or "Photograph" is executed, the operation for the reflective optical sensor 29 to detect the width of normal paper is performed.

Further, for matte paper, a print mode "Text Characters," which has a print resolution of "360×360 dpi", a print mode "Graph," which has a print resolution of "720×720 dpi", and a print mode "Photograph," which has a print resolution of "1440×720 dpi", are provided. The ON/OFF setting check box corresponding to the print mode "Text Characters" is initially set to OFF, and the ON/OFF setting check boxes corresponding to the print modes "Graph" and "Photograph" are initially set to ON. That is, in a state where the ON/OFF setting check boxes are in the initial setting, when the print mode "Text Characters" is executed, the operation for the reflective optical sensor 29 to detect the width of matte paper is stopped, whereas when the print mode "Graph" or "Photograph" is executed, the operation for the reflective optical sensor 29 to detect the width of matte paper is performed.

Furthermore, for photograph paper, only a print mode "Photograph," which has a print resolution of "1440×720 dpi", has been provided. The ON/OFF setting check box corresponding to the print mode "Photograph" is initially set to ON. That is, in a state where the ON/OFF setting check box is in the initial setting, when the print mode "Photograph" is executed, the operation for the reflective optical sensor 29 to detect the width of photograph paper is performed.

Further, for OHP paper, a print mode "Text Characters," which has a print resolution of "360×360 dpi", and a print mode "Graph," which has a print resolution of "720×720 dpi", are provided. The ON/OFF setting check box corresponding to the print mode "Text Characters" is initially set to OFF, and the ON/OFF setting check box corresponding to the print mode "Graph" is initially set to ON. That is, in a state where the ON/OFF setting check boxes are in the initial setting, when the print mode "Text Characters" is executed, the operation for the reflective optical sensor 29 to detect the width of OHP paper is stopped, whereas when the print mode "Graph" is executed, the operation for the reflective optical sensor 29 to detect the width of OHP paper is performed.

It should be noted that print paper P type, print mode type, print resolution type, and initial settings of the ON/OFF setting check boxes, of the color inkjet printer 20, are not limited to this configuration. That is, print paper P types, print mode types, and print resolution types other than the above can be provided, and the initial settings of the ON/OFF setting check boxes can be suitably altered, to correspond to the specifications of the color inkjet printer 20.

FIG. 15 is a data table showing the ON/OFF setting information on the display screen of FIG. 14. The data table of FIG. 15 correlates the print mode type and initial settings of the ON/OFF setting check boxes in terms of the type of print paper P. It should be noted that this data table is stored in a memory (not shown) of the computer 90.

First, when setting the operation for the reflective optical sensor 29 to detect the width of the print paper P to ON or OFF, the display screen of FIG. 14 is displayed on the CRT 21 in accordance with an instruction from the user interface display module 101. The user can select either the "ON" or "OFF" setting check box and add a check to it using, for example, the keyboard (not shown) or the mouse (mouse) of the computer 90 while confirming the information on this display screen. The setting information on this display screen is stored on the memory of the computer 90 as an updated data table when the information of the ON/OFF setting check boxes is changed from the initial setting information.

It should be noted that in the initial screen (display screen) that is shown on the CRT 21, only the print mode with a low print resolution and a short print time (for example, 360×360 dpi) has an initial setting of "OFF" in the ON/OFF setting check box. That is, for normal paper, matte paper, and OHP paper alike, a print mode of "Text Characters," which has a print resolution of "360×360 dpi", can be executed in a short time. Thus, the user is freed from having to perform the bothersome initial setting of stopping the operation for the reflective optical sensor 29 to detect the width of the print paper P, and can obtain a printed print paper P in a short time. Also, the operation through which the reflective optical sensor 29 detects the width of the print paper P can be easily set to ON or OFF according to user preference, and thus the recording apparatus has excellent versatility.

—Printing Method of the Third Embodiment—

Figure 16:
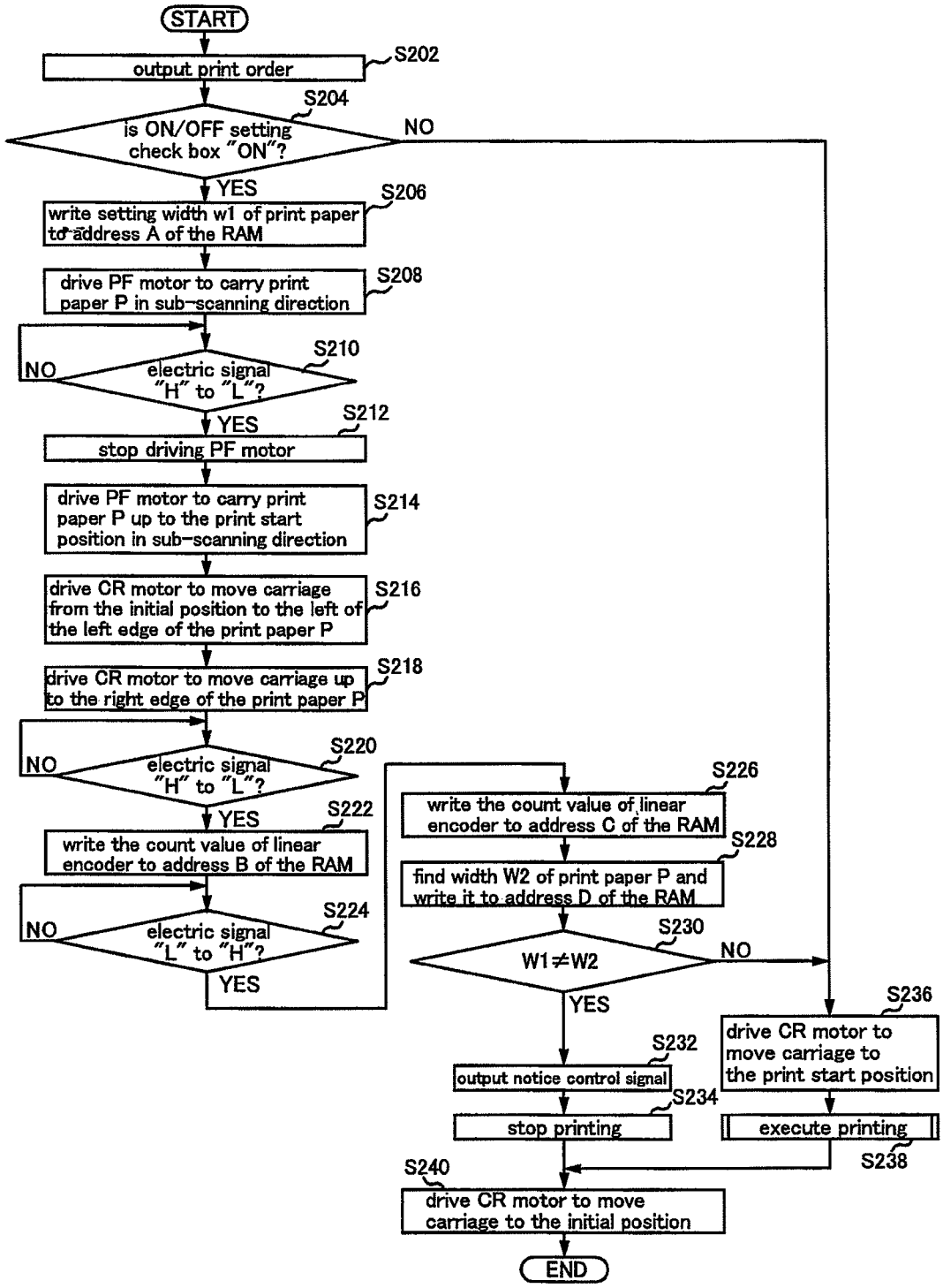
FIG. 16 is a flowchart for describing the printing method of the third embodiment.
Figure 17:
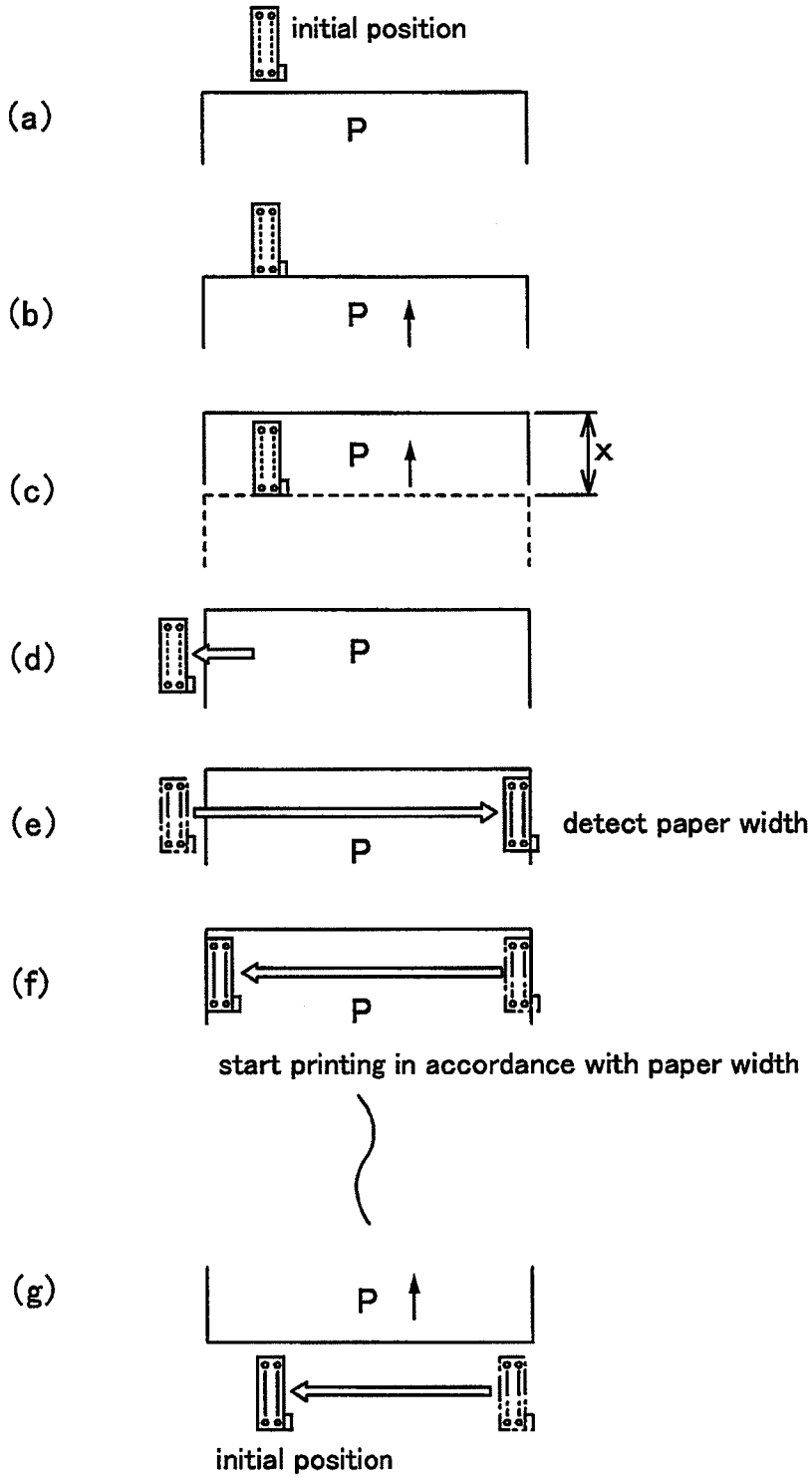
FIGS. 17(*a*) through 17(*g*) are schematic diagrams for describing the positional relationship between the print head 36, the reflective optical sensor 29, and the print paper P when printing is executed using the printing method of the third embodiment.

The printing method of the present embodiment is described below with reference to FIG. 16 and FIG. 17. FIG. 16 is a flowchart for describing the printing method of the present embodiment. FIG. 17 is a schematic diagram for describing the positional relationship between the print head 36, the reflective optical sensor 29, and the print paper P when printing is executed using the printing method of the present embodiment. It should be noted that in FIG. 16 the print head 36 is viewed from above (from the side opposite from the face of FIG. 8), and the white circles on the paper-face upper side of the print head 36 indicate the black nozzle #1 and the yellow nozzle #1, and the white circles on the paper-face lower side of the print head 36 indicate the black nozzle #180 and the cyan nozzle #60. Also, the print paper P is carried in the sub-scanning direction from the side with the black nozzle #180 and the cyan nozzle #60 when printing is executed (see FIG. 8).

First, when the power is turned on, the system controller 54 supplies control signals for initialization to the main-scan drive circuit 61, the sub-scan drive circuit 62, the head drive circuit 63, the reflective optical sensor control circuit 65, and the notice control circuit 67 in accordance with the results of interpreting the program data for initialization that are read from the main memory 56. As a result, the drive force of the CR motor 30 is transmitted to the carriage 28, and the carriage 28 stops at a predetermined initial position in the main-scanning direction. In other words, the print head 36 that is provided in the carriage 28 also stops at the same initial position (see FIG. 15(*a*)).

When the application program 95 receives an instruction for printing a predetermined image from the user, the application program 95 outputs a print order for printing the predetermined image to control the video driver 91 and the printer driver 96. As a result, the printer driver 96 obtains image data for printing the predetermined image from the application program 95, processes these into print data PD and various commands COM, and supplies them to the color inkjet printer 20. The color inkjet printer 20 supplies control signals for printing the predetermined image to the main-scan drive circuit 61, the sub-scan drive circuit 62, the head drive circuit 63, and the reflective optical sensor control circuit 65 in accordance with the print data PD and the various commands COM, and thus the following sequence is executed (S202).

The system controller 54 decodes a specific command COM, of the various commands COM, that has information on the ON/OFF setting check boxes, and determines whether or not to perform the operation for detecting the width of the print paper P with the reflective optical sensor 29. More specifically, it determines whether the setting of the ON/OFF setting check boxes for the print paper that has been selected through the user interface display module 101 is for "ON" or "OFF" (S204).

When the system controller 54 determines that the operation for detecting the width of the print paper P with the reflective optical sensor 29 is to be performed (S204: YES), it writes a width W1 of the size of the print paper that has been selected through the user interface display module 101 to the address A of the RAM 57 (S206).

The sub-scan drive circuit 62 drives the PF motor 31, and as a result the print paper P starts being carried toward the print head 36 in the sub-scanning direction (upward in the paper face of FIG. 17) (S208).

The system controller 54 determines whether or not the upper edge of the print paper P has been carried to the position of the reflective optical sensor 29. More specifically, the system controller 54 determines whether or not the upper edge of the print paper P has been carried to the position of the reflective optical sensor 29 based on the measurement results that are obtained from the electric signal measuring section 66 of the reflective optical sensor control circuit 65 (S210). Here, the electric signal measuring section 66 of the reflective optical sensor control circuit 65 measures the intensity of the electric signal that is obtained from the light-receiving member 40, and supplies the result of this measurement to the system controller 54. It should be noted that the logic within the electric signal measuring section 66 is designed so that the result of the measurement that is obtained from the electric signal measuring section 66 is at high level ("H") based on the intensity of the electric signal of the light-receiving member 40 when the light-emitting member 38 emits light onto the platen 26, and is at low level ("L") based on the intensity of the electric signal of the light-receiving member 40 when the light-emitting member 38 emits light onto the print paper P.

When the measurement result that is obtained from the electric signal measuring section 66 is at the high level, the system controller 54 determines that the upper edge of the print paper P has not been carried to the position of the reflective optical sensor 29 (S210: NO). In other words, step 206 is executed again and the sub-scan drive circuit 62 continues to drive the PF motor 31.

On the other hand, when the measurement result that is obtained from the electric signal measuring section 66 has changed from the high level to the low level, the system controller 54 determines that the upper edge of the print paper P has been carried to the position of the reflective optical sensor 29 (S210: YES/see FIG. 17(*b*)). At this time, the sub-scan drive circuit 62 stops driving the PF motor 31 (S212).

The system controller 54 supplies a control signal for carrying the print paper P up to the print start position to the sub-scan drive circuit 62, based on the result that is obtained by decoding the commands COM. The sub-scan drive circuit 62 drives the PF motor 31, and the print paper P is accordingly carried by a distance X from the stop position of FIG. 17(*b*) to the print start position, and is then stopped. It should be noted that the distance X is a distance that is set in accordance with various conditions, such as whether or not the upper edge side of the print paper P has a border, and if the upper edge side of the print paper P has a border, the width mm of the border. For example, in the case of a setting in which the upper edge side of the print paper P is borderless, then the distance X can be the distance 179 kD, which is the distance for the upper edge of the print paper P to come up to the position where the black nozzle #1 and the yellow nozzle #1 of the print head 36 are arranged, or it can be a distance that is less than 179 kD in order to ensure that printing is carried out reliably (S214/see FIG. 17(*c*)).

The system controller 54 supplies, to the main-scan drive circuit 61, a control signal for moving the carriage 28 from the initial position to the left of the left edge of the print paper P. The main-scan drive circuit 61 drives the CR motor 30 according to this control signal. Thus, the carriage 28 starts moving to the left from the initial position, and stops at the position where the reflective optical sensor 29 emits light onto the platen 26 to the left of the print paper P. That is, by the carriage 28 subsequently moving to the right in the main-scanning direction, the reflective optical sensor 29 becomes able to supply, to the reflective optical sensor control circuit 65, an electric signal for detection of the width W2 of the print paper P, or in other words, an electric signal whose level changes at the positions of the left edge and the right edge of the print paper P (S216/see FIG. 17(*d*)).

The system controller 54 supplies, to the main-scan drive circuit 61, a control signal for moving the carriage 28 from the left side of the left edge of the print paper P to the right edge of the print paper P. The main-scan drive circuit 61 drives the CR motor 30 according to this control signal. The carriage 28 thus starts moving to the right from the left side of the left edge of the print paper P. In other words, the operation through which the reflective optical sensor 29 detects the width W2 of the print paper P is started (S218/see FIG. 17(*e*)).

The system controller 54 determines whether or not the reflective optical sensor 29 is at the position of the left edge of the print paper P based on the measurement results obtained from the electric signal measuring section 66 of the reflective optical sensor control circuit 65 (S220).

When the measurement results obtained from the electric signal measuring section 66 have changed from the high level to the low level, the system controller 54 determines that the reflective optical sensor 29 has changed from a state in which it irradiates light onto the platen 26 to a state in which it irradiates light onto the print paper P, and that the reflective optical sensor 29 is at the position of the left edge of the print paper P (S220: YES).

The system controller 54 reads the count value of the linear encoder 11 at the point that the measurement result from the electric signal measuring section 66 changes from the high level to the low level and writes this to an address B of the RAM 57. The position of the left edge of the print paper P is thus determined (S222).

Similarly, the system controller 54 next determines whether or not the reflective optical sensor 29 is at the position of the right edge of the print paper P based on the measurement results obtained from the electric signal measuring section 66 of the reflective optical sensor control circuit 65 (S224).

When the measurement results obtained from the electric signal measuring section 66 have changed from the low level to the high level, the system controller 54 determines that the reflective optical sensor 29 has changed from a state in which it irradiates light onto the print paper P to a state in which it irradiates light onto the platen 26, and that the reflective optical sensor 29 is at the position of the right edge of the print paper P (S224: YES).

The system controller 54 reads the count value of the linear encoder 11 at the point that the measurement result obtained from the electric signal measuring section 66 changes from the low level to the high level and writes this to an address C of the RAM 57. The position of the right edge of the print paper P is thus determined (S226).

The system controller 54 finds the difference between the count values of the linear encoder 11 that are stored in the addresses B and C of the RAM 57, and by performing a predetermined computation correlating this difference and the slit spacing k, the system controller 54 finds the width W2 of the print paper P and writes this width W2 to an address D of the RAM 57 (S228).

The system controller 54 determines whether or not the setting width W1 of the print paper that is stored in the address A of the RAM 57 is equal to the width W2 of the print paper P that is stored in the address D of the RAM 57 (S230). It should be noted that an error $\pm\alpha$ is added to the setting width W1 of the print paper that has been selected through the user interface display module 101 when it is written to the address A of the RAM 57. The absolute value of the error $\pm\alpha$ is set to a value that is larger than the maximum value (experience value) of the dimensional error that may be present in the print paper P. Thus, the system controller 54 can determine that sheets of the print paper P are of the same standard size even if the sheets of the print paper P have error.

When the system controller 54 determines that the setting width W1 of the print paper that is stored in the address A of the RAM 57 is different from the width W2 of the print paper P that is stored in the address D of the RAM 57 (S230: YES), it supplies, to the notice control circuit 67, a signal that instructs to make a notice. The notice control circuit 67 supplies a display-notice control signal to the display panel 68, and supplies an audio-notice control signal to the speakers 69. Thus, the display panel 69 displays a message such as "Print paper size is different." and the speakers 69 emit a beep tone, for example, making it possible to urge the user to change the print paper P (S232).

The system controller 54 then supplies control signals for stopping printing to the main-scan drive circuit 61, the sub-scan drive circuit 62, and the head drive circuit 63. The main-scan drive circuit 61 stops driving the CR motor 30, and thus the carriage 28 stops. Also, the sub-scan drive circuit 62 drives the PF motor 31, and as a result the print paper P is carried in the sub-scanning direction and ultimately discharged. Further, the head drive circuit 63 stops driving the print head 36, and as a result the print head 36 no longer ejects ink. In other words, printing with respect to the print paper P is stopped (S234).

On the other hand, when the system controller 54 determines that the setting width W1 of the print paper that is stored in the address A of the RAM 57 is the same as the width W2 of the print paper P that is stored in the address D of the RAM 57 (S230: NO), it supplies, to the main-scan drive circuit 61, a control signal for moving the carriage 28 from the right edge of the print paper P to the print start position on the left side. The main-scan drive circuit 61 drives the CR motor 30 according to this control signal. As a result, the carriage 28 moves to the print start position on the left side of the print paper P from the right edge of the print paper P and stops (S236/see FIG. 17(*f*)).

The system controller 54 then supplies control signals for executing printing to the main-scan drive circuit 61, the sub-scan drive circuit 62, and the head drive circuit 63. The main-scan drive circuit 61 drives the CR motor 30, and thus the carriage 28 moves back and forth in the main-scanning direction. Also, the sub-scan drive circuit 62 drives the PF motor 31, and as a result the print paper P is carried in the sub-scanning direction in units of predetermined carry amounts. Further, the head drive circuit 63 drives the print head 36, causing the print head 36 to suitably eject ink based on the various information of the print data PD. In other words, these operations are carried out at an appropriate timing, and the predetermined image is printed on the print paper P (S238).

Lastly, the system controller supplies, to the main-scan drive circuit 61, a control signal for returning the carriage 28 to the initial position. The main-scan drive circuit 61 drives the CR motor 30 according to this control signal. As a result, the carriage 28 is moved to the initial position and stops, thereby being ready for the next print operation (S240/see FIG. 17(*g*)).

In step S204 above, when the system controller 54 determines that it is not necessary to perform the operation for the reflective optical sensor 29 to detect the width of the print paper P (S204: NO), it skips steps S206 to S228 and jumps to the negative branch of step S230, and then executes step S236 and subsequent steps. It should be noted that in the step S236 described above, the carriage 28 is described as moving from the right edge of the print paper P to the print start position on the left side of the print paper P and stopping. However, when the result is NO in step S204, then in step S236 the carriage 28 moves from the initial position to the print start position on the left side of the print paper P and stops.

It should be noted that the reflective optical sensor 29 can be constituted by individual units for detecting the upper edge, the left edge, and the right edge of the print paper P.

Incidentally, when the width of the print paper P that has been detected by the reflective optical sensor 29 is different from the width of the print paper that has been set in advance, it is possible to stop printing the print information to the print paper P. However, because there are various possibilities for the type and the resolution of the print paper P that can be used by the color inkjet printer 20, problems may occur when the reflective optical sensor 29 detects the width of various print papers Pall in the same way. For example, when executing a quick recording of low resolution information (such as text characters) to an inexpensive recording medium (such as normal paper), the user is likely to be very annoyed by the amount of time that it takes for the reflective optical sensor 29 to detect the width of the print paper P.

Accordingly, by making it possible to toggle the operation for the reflective optical sensor 29 to detect the width of the print paper P between ON and OFF, the print information can be efficiently printed to the print paper P.

It is also possible to adopt a configuration in which the ON/OFF of the operation for the reflective optical sensor 29 to detect the width of the print paper P is settable through the display screen.

Thus, because the operation for the reflective optical sensor 29 to detect the width of the print paper P can be set to ON and OFF on the display screen, the setting information can be reliably confirmed and print information can be efficiently printed to the print paper P.

It is also possible to adopt a configuration in which the ON/OFF of the operation for the reflective optical sensor 29 to detect the width of the print paper P is initially set to either one of ON and OFF in accordance with the type of the print paper P.

Thus, because the operation for the reflective optical sensor 29 to detect the width of the print paper P is initially set to either one of ON and OFF in accordance with the type of the print paper P, it is not necessary for the user to perform an initial setting, and this allows print information to be efficiently printed to the print paper P.

It is also possible to adopt a configuration in which the ON/OFF of the operation for the reflective optical sensor 29 to detect the width of the print paper P is initially set to either one of ON and OFF according to the resolution at which the print information is to be printed to the print paper P.

Thus, because the operation for the reflective optical sensor 29 to detect the width of the print paper P is initially set to either one of ON and OFF in accordance with the resolution at which the print information is to be printed to the print paper P, it is not necessary for the user to perform an initial setting, and this allows print information to be efficiently printed to the print paper P.

It is also possible to have a user interface display module 101 for setting the size of the print paper, and to make a notice when the width of the print paper P that has been detected by the reflective optical sensor 29 is different from a width of the print paper size that has been set through the user interface display module 101.

Thus, because a notice for notifying the user that the size of the print paper is different is made when the width of the print paper P that has been detected by the reflective optical sensor 29 is different from a width of the print paper size that has been set through the user interface display module 101, print information can be efficiently printed to print paper P of an appropriate size.

It is also possible for the reflective optical sensor 29 to detect the width of the print paper P before the print head 36 starts printing print information to the print paper P.

Thus, because the width of the print paper P is detected before the print head 36 starts printing print information to the print paper P, the print paper P is prevented from being wasted and print information can be efficiently printed to print paper P of an appropriate size.

It is also possible for the reflective optical sensor 29 to move in a direction that intersects the carrying direction of the print paper P and, based on whether or not the print paper P is present, to detect the width of the print paper P.

Thus, print information can be efficiently printed to the print paper P using a reflective optical sensor 29 that detects the width of the print paper P based on whether or not the print paper P is present in a direction that intersects the carrying direction of the print paper P.

It is further possible to provide both the reflective optical sensor 29 and the print head 36 in/on the carriage 28, which is for moving in a direction that intersects the carrying direction of the print paper P.

By using a reflective optical sensor 29 that is provided together with the print head 36 on the carriage 28, which is for moving in a direction that intersects the carrying direction of the print paper P, it is possible to efficiently print the print information to the print paper P.

It is also possible for the reflective optical sensor 29 to have the light-emitting member 38 for emitting light and the light-receiving member 40 for receiving the light emitted from the light-emitting member 38, and to detect whether or not the print paper P is present based on the output value of the light-receiving member 40.

Thus, by using a reflective optical sensor 29 that has the light-emitting member 38 for emitting light and the light-receiving member 40 for receiving light emitted from the light-emitting member 38, it is possible to efficiently print the print information to the print paper P.

—Others (Third Embodiment)—

A recording apparatus, a recording method, a program, and a computer system according to the present invention were described above through an embodiment thereof. However, the foregoing embodiment of the invention is for the purpose of elucidating the present invention and is not to be interpreted as limiting the present invention. The invention can of course be altered and improved without departing from the gist thereof, and includes equivalents.

<Setting Detection Operation by Detection Means to ON or OFF>

The present embodiment was described using a case where the operation for performing detection with the reflective optical sensor 29 is set to ON and OFF using the printer driver 96, but this is not a limitation. For example, it is also possible to set the operation through which the reflective optical sensor 29 performs detection to ON or OFF using the display panel 68 of the color inkjet printer 20. In this way, it becomes possible to set the operation through which the reflective optical sensor 29 performs detection to ON or OFF using only the color inkjet printer 20.

<Notice>

In the foregoing embodiment, a case in which a notice is made using the display panel 68 and the speakers 69 provided in the color inkjet printer 20 is described, but this is not a limitation. For example, it is possible for the application program 95 to decode the notice command COM that is supplied from the color inkjet printer 20 and drive the video driver 91 to display on the CRT 21 a display message (for example, a written message such as "Paper size is incorrect." or an illustration) for indicating that the size of the print paper P that is provided in the color inkjet printer 20 is different from the size of the print paper that has been set. At this time, it is also possible to simultaneously emit a sound from the speakers 69. Thus, the CRT 21, which is larger than the display panel 68, can be used to effectively make a notice.

<Detection Means>

The light-emitting member 38 and the light-receiving member 40 that make up the reflective optical sensor 29 serving as the detection means are provided together with the print head 36 on the carriage 28, but there is no limitation to this configuration. For example, it is possible to adopt a light-emitting member 38 and a light-receiving member 40 that are moved in the main-scanning direction in synchronization with the carriage 28 but that are separate from the carriage 28. Also, the detection means is not limited to the reflective optical sensor 29. For example, a transmissive optical sensor wherein the print paper P is interposed on the path over which light is emitted and received, a line sensor, or an area sensor, for example, can also be employed.

<Recording Medium>

The recording medium is not limited to the print paper P. Cloth, thin metal plates, and film, for example, can also be used as the recording medium.

<Recording Apparatus>

The recording apparatus, as a printer, is not limited to the color inkjet printer 20. For example, the recording apparatus can also be adopted for monochrome inkjet printers or printers that do not employ the inkjet method, for example. In such a case, the printer can have some of the functions or the mechanisms of the main computer unit, the display device, the input device, the flexible disk drive device, and the CD-ROM drive device. For example, the printer can have an image processing section for carrying out image processing, a display section for carrying out various types of displays, and a recording media attachment/detachment section to and from which a recording medium, on which image data captured by a digital camera or the like are recorded, can be attached and detached.

Furthermore, the recording apparatus is not limited to a printer. For example, it is also possible to adopt the recording apparatus to a color filter manufacturing device, a dyeing device, a fine processing device, a semiconductor manufacturing device, a surface processing device, a three-dimensional shape forming machine, a liquid vaporizing device, an organic EL manufacturing device (particularly a macromolecular EL manufacturing device), a display manufacturing device, a film formation device, and a DNA chip manufacturing device, for example. When the present invention is employed in these fields, it is possible to achieve a reduction in material, process steps, and costs compared to conventional cases because one of its characteristics is that liquid can be directly ejected (directly written) onto a target object.

<Liquid>

The liquid is not limited to ink (such as dye inks and pigment inks). For example, it is also possible to employ liquid (including water) including metallic material, organic material (particularly macromolecular material), magnetic material, conductive material, wiring material, film-formation material, electronic ink, machining liquid, and genetic solutions.

With the third embodiment, recording information can be efficiently recorded to the recording medium.

INDUSTRIAL APPLICABILITY

With the present invention, it is possible to achieve a recording apparatus, a recording method, a program, and a computer system with which recording media can be effectively used without the recording apparatus itself becoming dirty. With the present invention, it is also possible to achieve a recording apparatus, a recording method, a program, and a computer system with which recording information can be efficiently recorded to recording media.

The invention claimed is:

1. A recording apparatus comprising:

carrying means for carrying a recording medium;

detection means that can move in a direction that intersects the carrying direction of said recording medium and that is for detecting a width of said recording medium in the direction that intersects the carrying direction of said recording medium; and a recording head for ejecting liquid to record recording information;

wherein if a width of said recording medium that has been detected by said detection means is shorter than a width, in the direction that intersects the carrying direction of said recording medium, over which said recording information is to be recorded, then a portion of the recording information, of the entire recording information, corresponding to the width, or to less than the width, of said recording medium that has been detected by said detection means is recorded onto said recording medium by said recording head.

2. A recording apparatus according to claim 1, wherein if the width of said recording medium that has been detected by said detection means is shorter than the width, in the direction that intersects the carrying direction of said recording medium, over which said recording information is to be recorded, then a portion of the recording information, of the entire recording information, corresponding to the width of said recording medium that has been detected by said detection means is recorded onto said recording medium by said recording head.

3. A recording apparatus according to claim 1, wherein if the width of said recording medium that has been detected by said detection means is shorter than the width, in the direction that intersects the carrying direction of said recording medium, over which said recording information is to be recorded, then a portion of the recording information, of the entire recording information, corresponding to a width obtained by subtracting a border width from the width of said recording medium that has been detected by said detection means is recorded onto said recording medium by said recording head.

4. A recording apparatus according to claim 1, wherein said detection means moves in the direction that intersects the carrying direction of said recording medium and detects whether or not said recording medium is present, and detects the width of said recording medium based on whether or not said recording medium is present.

5. A recording apparatus according to claim 1, wherein said detection means and said recording head are both provided in/on a moving member for moving in the direction that intersects the carrying direction of said recording medium.

6. A recording apparatus according to claim 1, wherein said detection means has a light-emitting member for emitting light and a light-receiving member for receiving the light that is emitted by said light-emitting member, and detects whether or not said recording medium is present based on an output value of said light-receiving member.

7. A recording apparatus comprising:

carrying means for carrying a recording medium;

detection means that can move in a direction that intersects the carrying direction of said recording medium and that is for detecting a width of said recording medium in the direction that intersects the carrying direction of said recording medium;

setting means for setting a size of said recording medium; and a recording head for ejecting liquid to record recording information;

wherein a notice is made when the width of said recording medium that has been detected by said detection means is different from a width of the size of said recording medium that has been set with said setting means.

8. A recording apparatus according to claim 7, wherein a notice is made using audio information.

9. A recording apparatus according to claim 7, wherein a notice is made using display information.

10. A recording apparatus according to claim 7, wherein said recording apparatus stops recording the recording information to said recording medium when the width of said recording medium that has been detected by said detection means is different from the width of the size of said recording medium that has been set with said setting means.

11. A recording apparatus according to claim 7, wherein the size of said recording medium that has been set with said setting means includes a predetermined error, and a notice is made when the width of said recording medium that has been detected by said detection means differs, by an amount of said error or more, from the width of the size of said recording medium that has been set with said setting means.

12. A recording apparatus according to claim 11, wherein the width of the size of said recording medium that has been set by said setting means includes the predetermined error, and a notice is made when the width of said recording medium that has been detected by said detection means differs, by an amount of said error or more, from the width of the size of said recording medium that has been set by said setting means.

13. A recording apparatus according to claim 7, wherein said detection means moves in the direction that intersects the carrying direction of said recording medium and detects the width of said recording medium based on whether or not said recording medium is present.

14. A recording apparatus according to claim 7, wherein said detection means and said recording head are both provided in/on a moving member for moving in the direction that intersects the carrying direction of said recording medium.

15. A recording apparatus according to claim 7, wherein said detection means has a light-emitting member for emitting light and a light-receiving member for receiving the light that is emitted by said light-emitting member, and detects whether or not said recording medium is present based on an output value of said light-receiving member.

16. A recording apparatus comprising:

carrying means for carrying a recording medium;

detection means that can move in a direction that intersects the carrying direction of said recording medium and that is for detecting a width of said recording medium in the direction that intersects the carrying direction of said recording medium; and a recording head for ejecting liquid to record recording information;

wherein ON/OFF of an operation through which said detection means detects the width of said recording medium is settable through a display screen;

wherein the ON/OFF of the operation through which said detection means detects the width of said recording medium is initially set to either one of ON and OFF in accordance with a type of said recording medium or a resolution at which the recording information is to be recorded to said recording medium;

wherein said recording apparatus further comprises setting means for setting a size of said recording medium;

wherein a notice is made when the width of said recording medium that has been detected by said detection means is different from a width of the size of said recording medium that has been set with said setting means;

wherein, before said recording head starts the recording of the recording information to the recording medium, said detection means moves in the direction that intersects the carrying direction of said recording medium and detects the width of said recording medium based on whether or not said recording medium is present;

wherein said detection means and said recording head are both provided in/on a moving member for moving in the direction that intersects the carrying direction of said recording medium; and wherein said detection means has a light-emitting member for emitting light and a light-receiving member for receiving the light that is emitted by said light-emitting member, and detects whether or not said recording medium is present based on an output value of said light-receiving member.

* * * * *